US006137971A

United States Patent [19]

Sasaki et al.

[11] Patent Number: 6,137,971

[45] **Date of Patent: *Oct. 24, 2000**

[54] END MEMBER AND PROCESS CARTRIDGE

[75] Inventors: Teruhiko Sasaki; Satoshi Kurihara, both of Toride; Tsutomu Nishiuwatoko, Kashiwa, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/294,368

[22] Filed: Apr. 20, 1999

[30] Foreign Application Priority Data

Apr. 24, 1998 [JP] Japan ..... 10-115071

[51] Int. Cl.[7] ..... G03G 15/00

[52] U.S. Cl. ..... 399/106; 399/111

[58] Field of Search ..... 399/102, 103, 399/105, 106, 111, 113, 119, 120

[56] References Cited

U.S. PATENT DOCUMENTS 5,585,902 12/1996 Nishiuwatoko et al. ..... 399/106
5,689,772 11/1997 Fujiwara et al. ..... 399/106
5,729,796 3/1998 Miura et al. ..... 399/114
5,768,660 6/1998 Kurihara et al. ..... 399/111
5,815,644 9/1998 Nishiuwatoko et al. ..... 399/113
5,870,654 2/1999 Sato et al. ..... 399/109
5,870,655 2/1999 Nishiuwatoko et al. ..... 399/111
5,878,309 3/1999 Nomura et al. ..... 399/111
5,893,006 4/1999 Kanno et al. ..... 399/13
5,920,753 7/1999 Sasaki et al. ..... 399/111
5,937,237 8/1999 Nonaka et al. ..... 399/106
5,937,240 8/1999 Kanno et al. ..... 399/111
5,943,528 8/1999 Akutsu et al. ..... 399/111 X

FOREIGN PATENT DOCUMENTS

08/305251 11/1996 Japan .
9-274381 10/1997 Japan .

*Primary Examiner*—Sophia S. Chen
*Attorney, Agent, or Firm*—Fitzpatrick, Cella, Harper & Scinto

[57] ABSTRACT

The present invention facilitates the work for filling developer into a developer containing portion. An end member, used for a process cartridge, has a detachable handle member, which connects with one end in a longitudinal direction of a sealing member, for being held when the sealing member is unsealed, and is mounted on one end in a longitudinal direction of the developer containing portion to cover a developer filling port.

23 Claims, 18 Drawing Sheets

END MEMBER AND PROCESS CARTRIDGE

BACKGROUND OF THE INVENTION

1. Field of the Invention

The present invention relates to an end member employed for a process cartridge and a process cartridge which are used in an electrophotographic image forming apparatus.

Here, the electrophotographic image forming apparatus forms an image on a recording material using an electrophotographic image formation process. Examples of the electrophotographic image forming apparatus includes an electrophotographic copying machine, an electrophotographic printer (laser beam printer, LED printer or the like), a facsimile machine and a word processor or the like.

The process cartridge contains integrally an electrophotographic photosensitive member and charging means, developing means or cleaning means, and is detachably mountable relative to a main assembly of the image forming apparatus. It may integrally contain the electrophotographic photosensitive member and at least one of the charging means, the developing means and the cleaning means. As another example, it may contain the electrophotographic photosensitive member and at least the developing means.

2. Related Background Art

In an electrophotographic image forming apparatus using an electrophotographic image forming process, the process cartridge is used. The cartridge which contains the electrophotographic photosensitive member and process means actable on the electrophotographic photosensitive member. The cartridge is detachably mountable as a unit to a main assembly of the image forming apparatus (process cartridge type). With this process cartridge, the maintenance of the apparatus can be carried out by the user without depending on a serviceman. Therefore, the process cartridge is now widely used in electrophotographic image forming apparatuses.

Such a process cartridge is integrally provided with a toner frame having a toner chamber containing developer (toner) and a developing frame containing a developing member, and a toner seal member for sealing the toner until the process cartridge begins to be used. The toner seal member is provided between the toner frame and the developing frame. Both of the frames are connected to a drum frame for supporting an electrophotographic photosensitive member.

Here, some of the toner seal members are fixed to a handle member integrally molded on the toner frame by fixing means, such as an adhesive double coated tape. A part of the handle member integrally molded on the toner frame has a notched portion that can be easily bent and cut by a user. The user bends and cuts the notched portion of the handle member and pulls off the handle member, and thereby the toner seal member is unsealed.

SUMMARY OF THE INVENTION

The present invention has been made by developing the above-described prior art.

An object of the present invention is to provide an end member capable of easily unsealing a sealing member, and a process cartridge in which the end member is used.

Another object of the present invention is to provide an end member capable of improving the unsealing operation efficiency of the sealing member, and a process cartridge in which the end member is used.

Still another object of the present invention is to provide an end member capable of facilitating the work for filling developer into a developer containing portion regardless of the use of a developer filling device or the manual operation, and a process cartridge in which the end member is used.

Yet another object of the present invention is to provide an end member used for a process cartridge having an electrophotographic photosensitive member; a developing member for developing a latent image formed on the electrophotographic photosensitive member; a developer containing portion for containing developer used for the developing of the developing member; a developer filling port, which is provided at one end in the longitudinal direction of the developer containing portion, for filling the developer into the developer containing portion; a developer passage opening through which the developer contained in the developer containing portion passes when the developer is supplied to the developing member; and a sealing member for sealing the developer passage opening so as to be capable of being unsealed.

The end member has a detachable handle member, which connects with one end in the longitudinal direction of the sealing member, and which is held when the sealing member is unsealed. The end member is mountable at one end in the longitudinal direction of the developer containing portion to cover the developer filling port.

Also, another object of the present invention is provide a process cartridge attachable to and detachable from a main body of an electrophotographic image forming apparatus, comprising: an electrophotographic photosensitive member; a developing member for developing a latent image formed on the electrophotographic photosensitive member; a developer containing portion for containing developer used for the developing of the developing member; a developer filling port, which is provided at one end in the longitudinal direction of the developer containing portion, for filling the developer into the developer containing portion; a developer passage opening through which the developer contained in the developer containing portion passes when the developer is supplied to the developing member; a sealing member for sealing the developer passage opening so as to be capable of being unsealed; and an end member which has a detachable handle member, which connects with one end in the longitudinal direction of the sealing member, and which is held when the sealing member is unsealed. The end member is mounted at one end in the longitudinal direction of the developer containing portion to cover the developer filling port.

DETAILED DESCRIPTION OF THE PREFERRED EMBODIMENTS

First, Embodiment 1 will be described with reference to FIGS. 1 to 8.

[Embodiment 1]

Here, Embodiment 1 is described in the order of (1) the whole configuration of an image forming apparatus and a process cartridge, (2) the frame configuration of developing means, and (3) the configuration of an end member and a handle member.

In the following description, the term "longitudinal direction" refers to a direction which is perpendicular to a direction in which the process cartridge is inserted into a main body of the apparatus and is parallel to a surface of a recording medium. Also, a direction perpendicular to the longitudinal direction is referred to as a width direction.

(Whole configuration)

Figure 1:
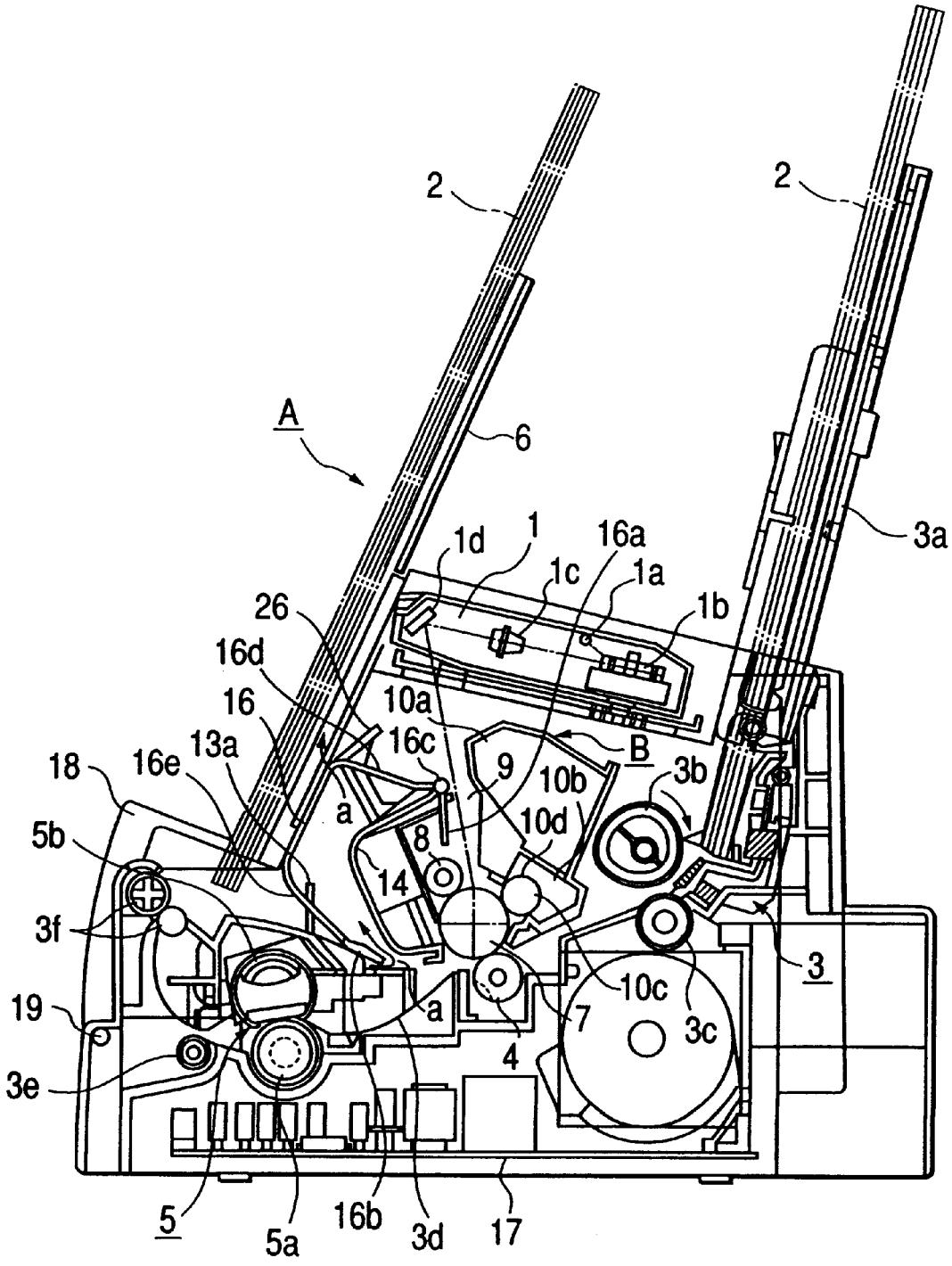
FIG. 1 is a longitudinal sectional view of an image forming apparatus on which a process cartridge is mounted.
Figure 2:
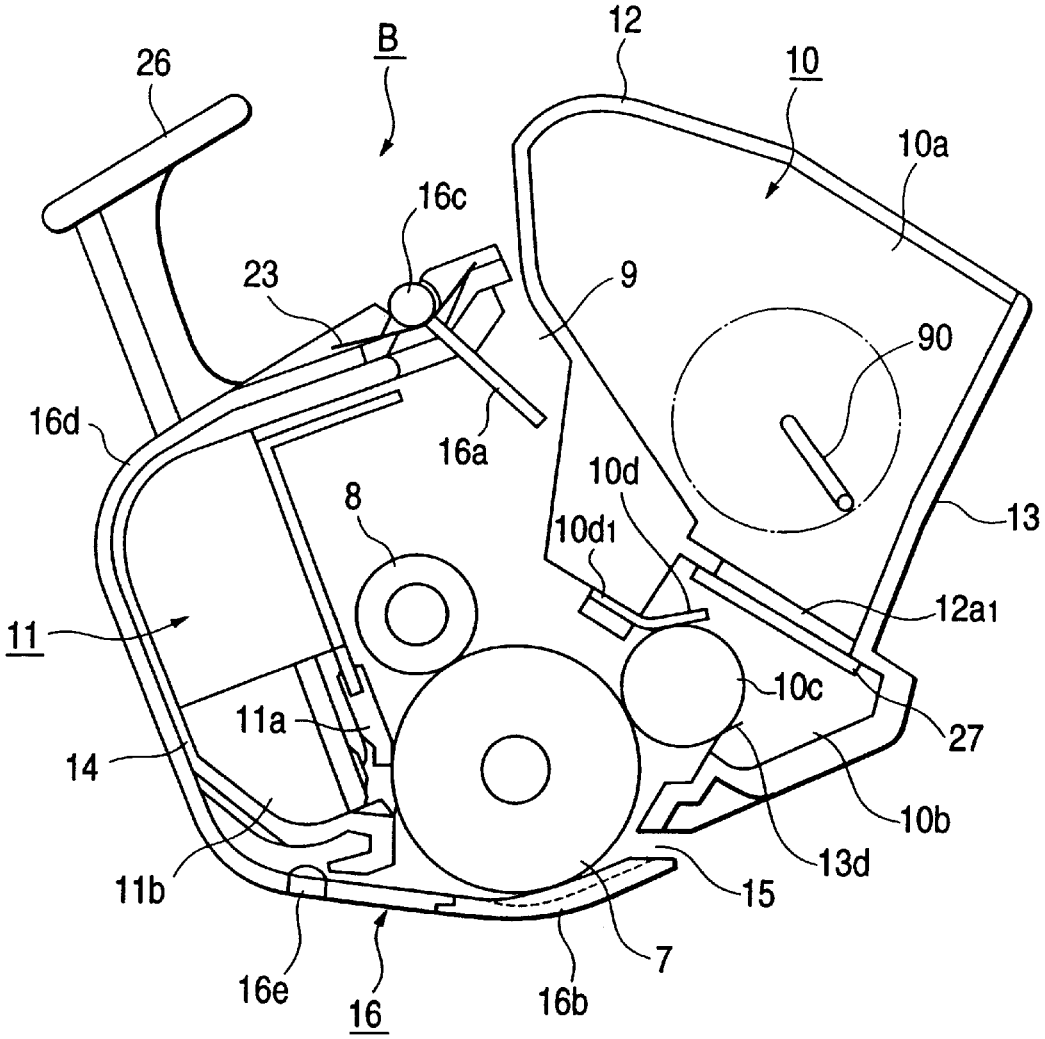
FIG. 2 is a longitudinal sectional view of the process cartridge.
Figure 3:
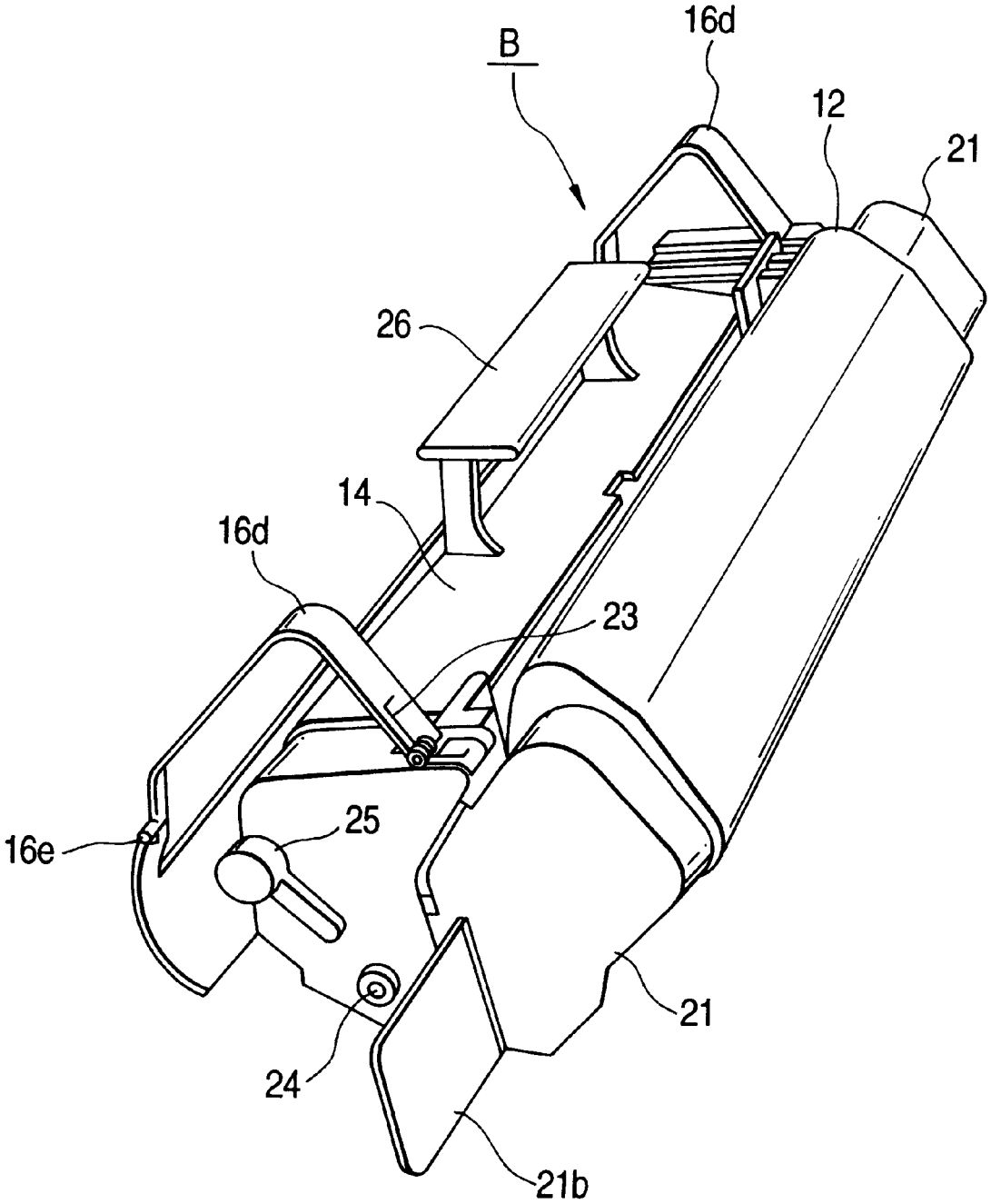
FIG. 3 is a perspective view of the process cartridge.
Figure 4:
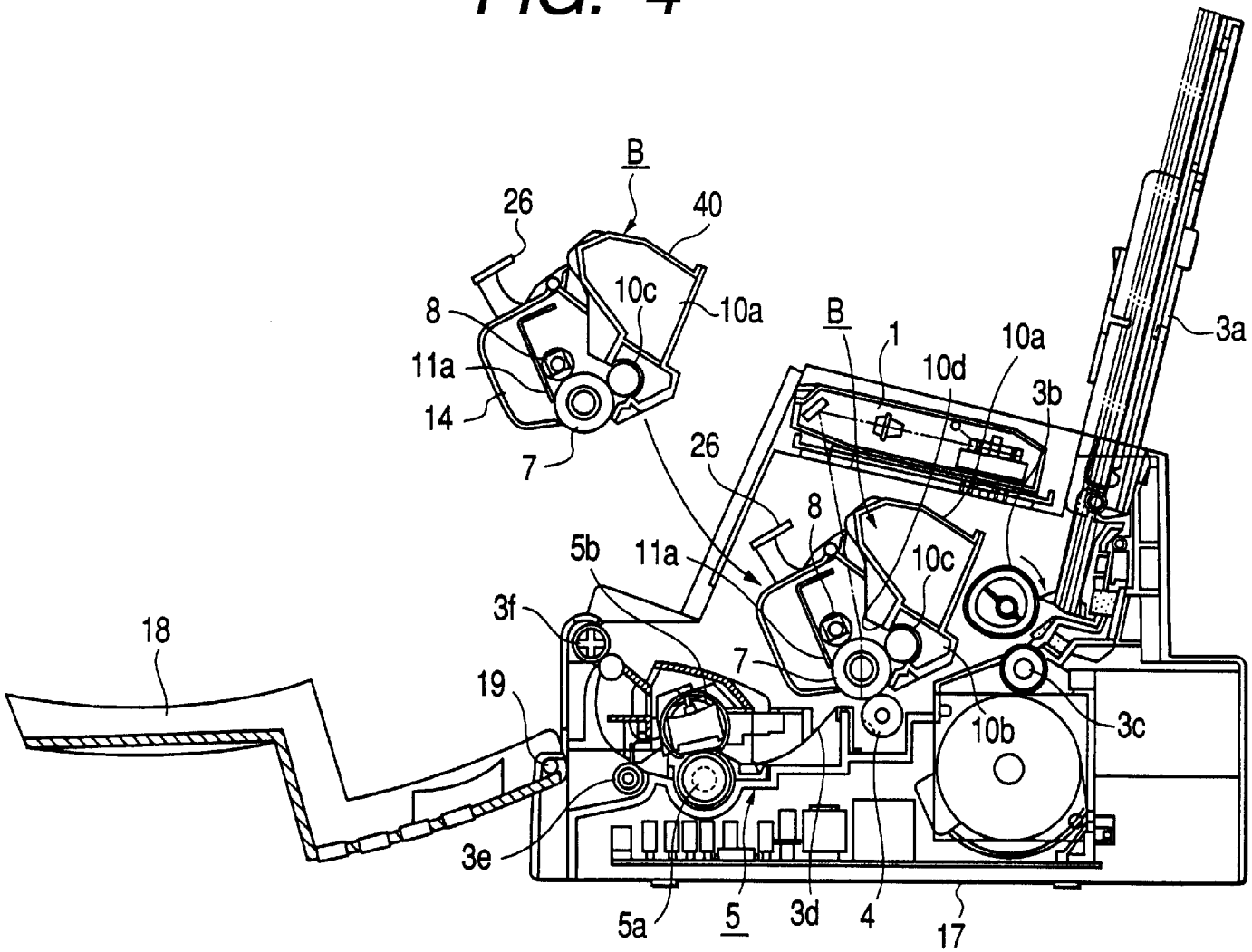
FIG. 4 is a longitudinal sectional view showing a state in which the process cartridge is mounted by opening an openable and closable cover of the image forming apparatus.

First, the whole configuration of the electrophotographic image forming apparatus and the process cartridge will be described with reference to FIGS. 1 to 4. FIG. 1 is an explanatory view showing the whole configuration of the electrophotographic image forming apparatus on which the process cartridge is mounted. FIGS. 2 and 3 are explanatory views of the configuration of the process cartridge. FIG. 4 is an explanatory view for illustrating a state in which the process cartridge is mounted on the main body of the apparatus by opening an openable and closable cover.

As shown in FIG. 1, this electrophotographic image forming apparatus A forms an image on a recording medium by an electrophotographic image formation process. It forms a toner image on a drum-shaped electrophotographic photosensitive member (hereinafter referred to as a photosensitive drum), which is an image bearing member. In synchronization with the formation of the toner image, a recording medium 2 set in a feed tray 3*a* is conveyed by conveying means 3 comprising a pickup roller 3*b* and a conveying roller 3*c*, etc. Next, the toner image formed on the photosensitive drum that the process cartridge B has is transferred to the recording medium 2 by applying a voltage to a transfer roller 4 serving as transferring means. Subsequently, the recording medium 2 onto which the toner image has been transferred is conveyed to fixing means 5 through a guide 3*d*. This fixing means 5, comprising a drive roller 5*a* and a fixing roller 5*b* incorporating a heater, fixes the toner image which has been transferred by applying heat and pressure to the recording medium 2 that passes through the fixing means 5. Then, the recording medium 2 is discharged into a discharge tray 6 by being turned over and conveyed by discharge rollers 3*e* and 3*f*.

On the other hand, the process cartridge B rotates a photosensitive drum 7 having a photosensitive layer serving as an image bearing member, and uniformly charges the surface of the photosensitive drum 7 by applying a voltage to a charging roller 8 serving as a charging member, as shown in FIGS. 1 and 2. Next, a laser beam, in accordance with image information from an optical system 1, irradiates the photosensitive drum 7 via an exposure opening 9, thereby forming a latent image. This latent image is developed by developing means 10 using toner. That is to say, the charging roller 8 serving as the charging member, which is provided in contact with the photosensitive drum 7, charges the photosensitive drum 7. Also, the developing means 10 supplies toner to a developing region of the photosensitive drum 7, and thereby develops the latent image formed on the photosensitive drum 7. The optical system 1 includes a laser diode 1*a*, a polygon mirror 1*b*, a lens 1*c*, and a reflecting mirror 1*d*.

The developing means 10 supplies toner in a toner chamber 10*a* serving as a toner containing portion to a developing chamber 10*b*, and rotates a developing roller 10*c* installed in the developing chamber 10*b*. It also forms a toner layer, to which a triboelectric charge is given by a developing blade 10*d*, on the surface of the developing roller 10*c* incorporating a stationary magnet, and supplies the toner to the developing region of the photosensitive drum 7. The toner is transferred to the photosensitive drum 7 in accordance with the latent image, by which a toner image is formed and visualized.

A voltage that is opposite in polarity to the toner image is applied to the transfer roller 4, by which the toner image formed on the photosensitive drum 7 is transferred to the recording medium 2. Subsequently, residual toner on the photosensitive drum 7 is removed by cleaning means 11. The cleaning means 11 scrapes off the toner remaining on the photosensitive drum 7 by using an elastic cleaning blade 11*a*, and collects the scraped toner in a waste toner reservoir 11*b*.

The elements including the photosensitive drum 7 are contained in a cartridge frame configured by combining a toner developing frame 12, a toner developing wall member 13, and a cleaning frame 14, thereby forming a cartridge. Specifically, the toner chamber 10*a* and the developing chamber 10*b* are formed by welding the toner developing frame 12 and the toner developing wall member 13 to each other, and the developing roller 10*c* and the developing blade 10*d* are installed in the developing chamber 10*b*. Also, the cleaning frame 14 is fitted with the photosensitive drum 7, the charging roller 8, and the elements configurating the cleaning means 11. The process cartridge B is formed by connecting the toner developing frame 12 to the cleaning frame 14 so as to be capable of oscillating.

The process cartridge B is provided with the exposure opening 9 for irradiating, in accordance with image information, the photosensitive drum 7 and a transfer opening 15 for causing the photosensitive drum 7 to face to the recording medium 2. The openings 9 and 15 each have a shutter member 16 for opening and closing the opening. The transfer opening 15 is used to transfer the toner image formed on the photosensitive drum 7 to the recording medium 2.

As shown in FIG. 4, the image forming apparatus A is provided with an openable and closable cover 18 which pivots on a shaft 19 with respect to the main body 17 of the apparatus. In the main body 17 of the apparatus are provided guide members (rail grooves, not shown) for guiding the process cartridge B, which are seen when the openable and closable cover 18 is opened. The operator attaches or detaches the process cartridge B along the guide members. At this time, as shown in FIG. 3, first protrusions 24 and second protrusions 25 provided on end walls in the longitudinal direction of the process cartridge B are guided along the guide members (not shown) of the main body 17 of the apparatus.

As shown in FIGS. 2 and 3, the shutter member 16 has a first shutter portion 16*a* fixed to a rotatably supported rotating support shaft 16*c* and a second shutter portion 16*b* supported by an arm portion 16*d*. The first shutter portion 16*a* is urged so as to close the exposure opening 9 and the second shutter portion 16*b* is urged so as to close the transfer opening 15 by the spring force of a torsion coil spring 23 mounted to the rotating support shaft 16*c*. When the process cartridge B is on the outside of the main body 17 of the apparatus, the first shutter portion 16*a* and the second shutter portion 16*b* close the exposure opening 9 and the transfer opening 15, respectively.

When the process cartridge B is mounted on the main body 17 of the apparatus by holding a handle portion 26 provided integrally on the cleaning frame 14, an engaging protrusion 16*e*, which projects outward in the longitudinal direction of a distal end of the arm portion 16*d* supporting the second shutter portion 16*b* covering the photosensitive drum 7, abuts against the main body 17 of the apparatus. The process cartridge B is advanced by causing the first and second protrusions 24 and 25 to go along the not illustrated guide members of the main body 17 of the apparatus in a state in which the shutter member 16 is inhibited from further advancing to the cartridge mounting portion. Thereby, the shutter member 16 comes to a position where the exposure opening 9 and the transfer opening 15 are opened as shown in FIG. 3. When the process cartridge B is removed from the main body 17 of the apparatus, the shutter member 16 closes the exposure opening 9 and the transfer opening 15 by means of the spring force of the torsion coil spring 23.

(Configuration of developing means)

Figure 5:
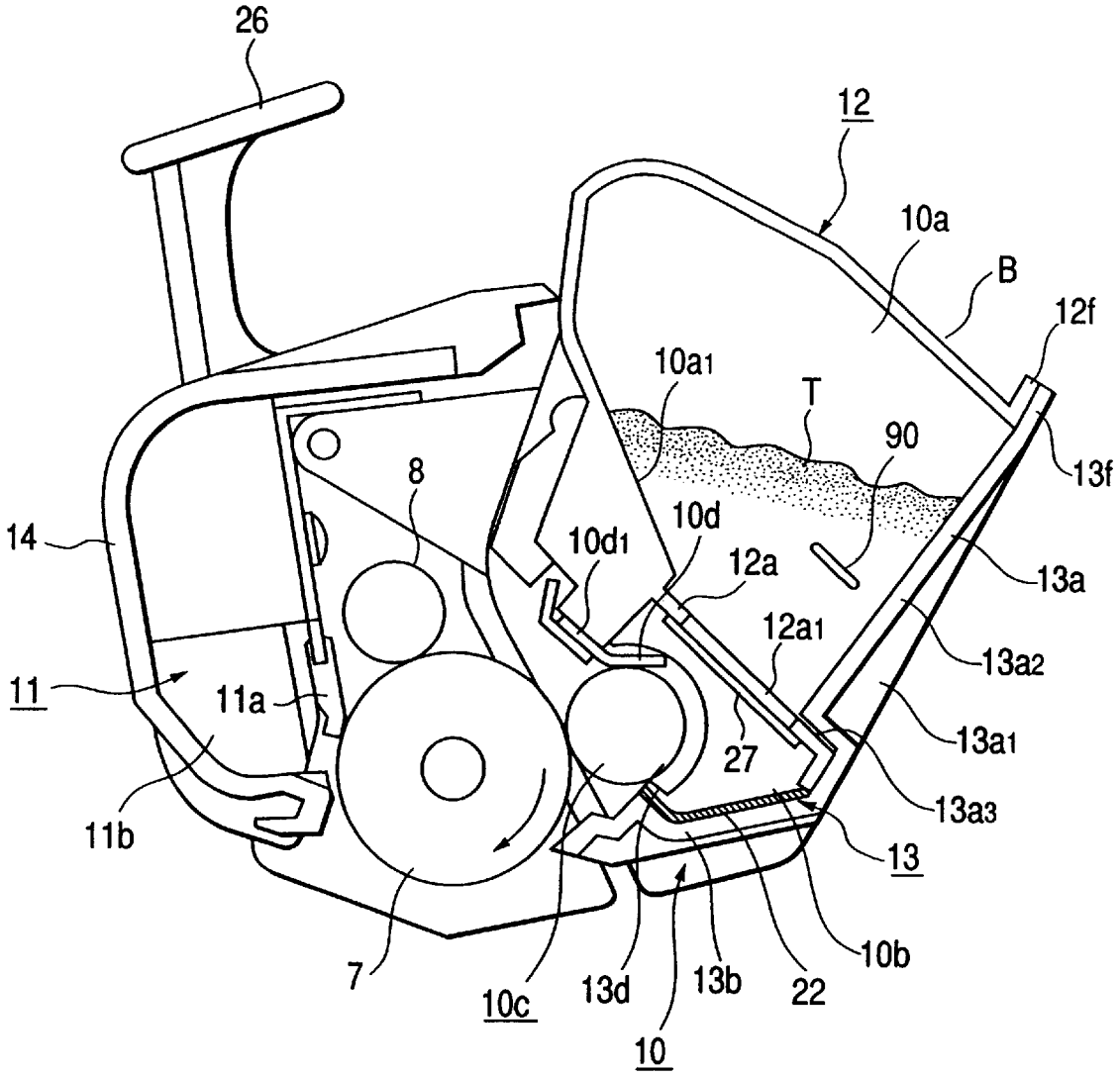
FIG. 5 is a longitudinal sectional view of the process cartridge.
Figure 7:
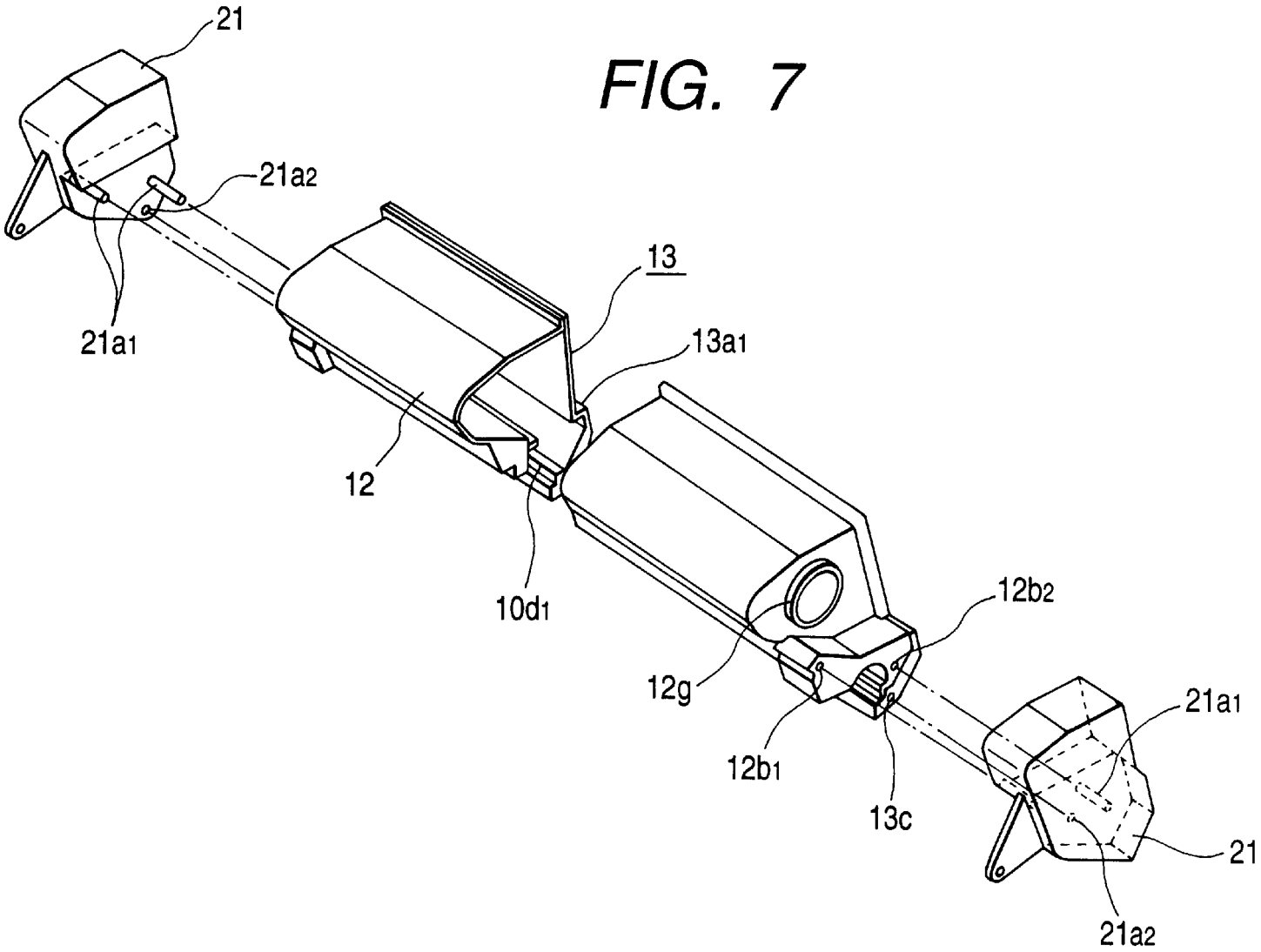
FIG. 7 is a perspective view for illustrating the assembly for connecting the toner developing frame to the toner developing wall member.
Figure 8:
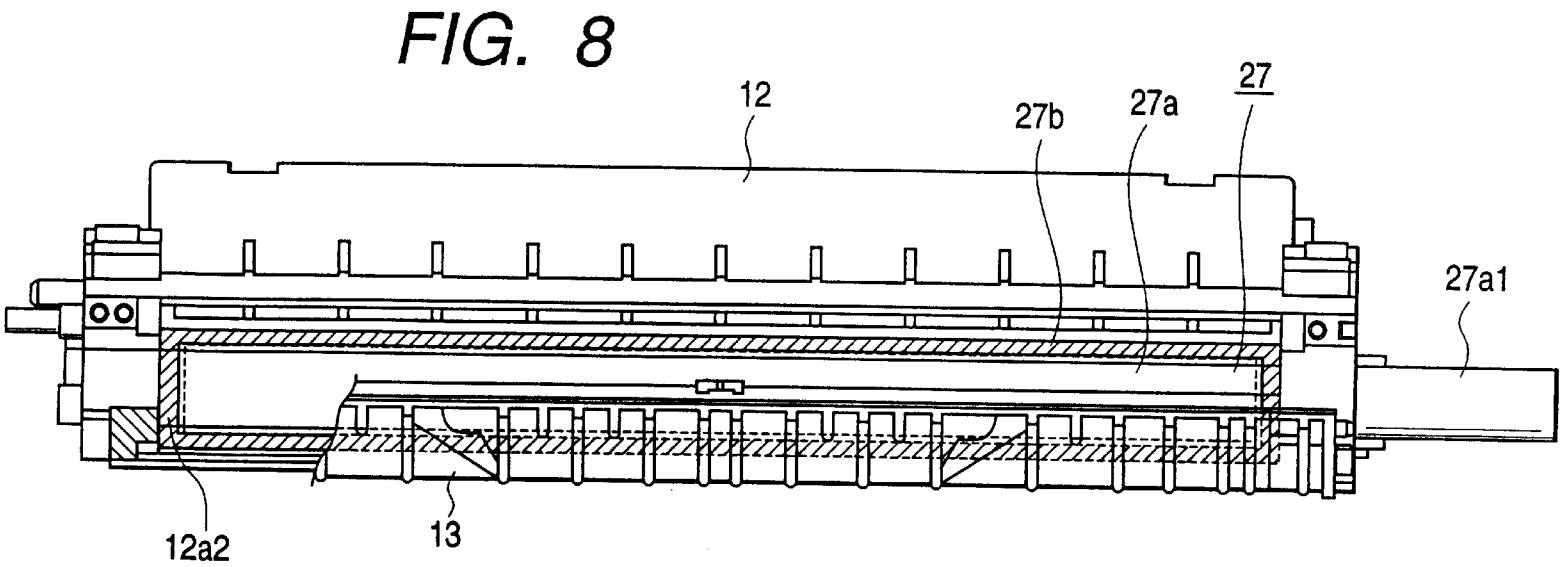
FIG. 8 is a front view for illustrating the connection of a toner seal member to the toner developing frame.
Figure 9:
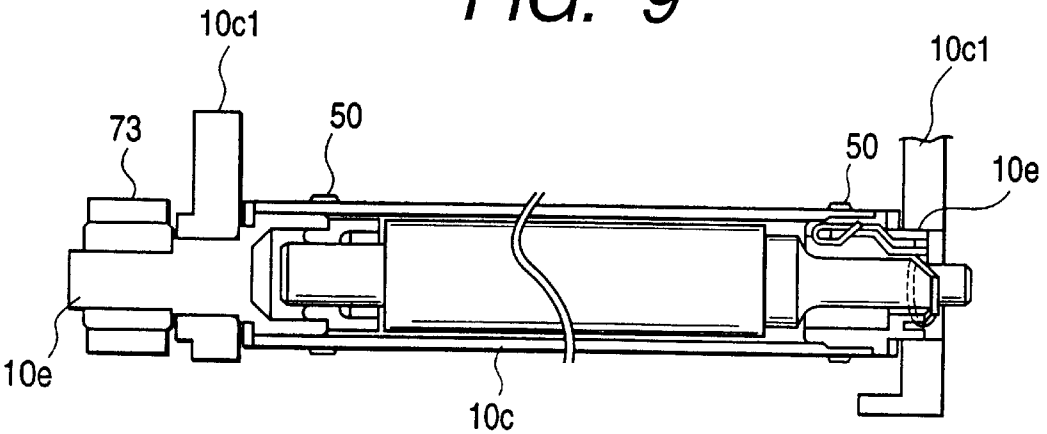
FIG. 9 is a view for illustrating a support construction for a developing roller.
Figure 10:
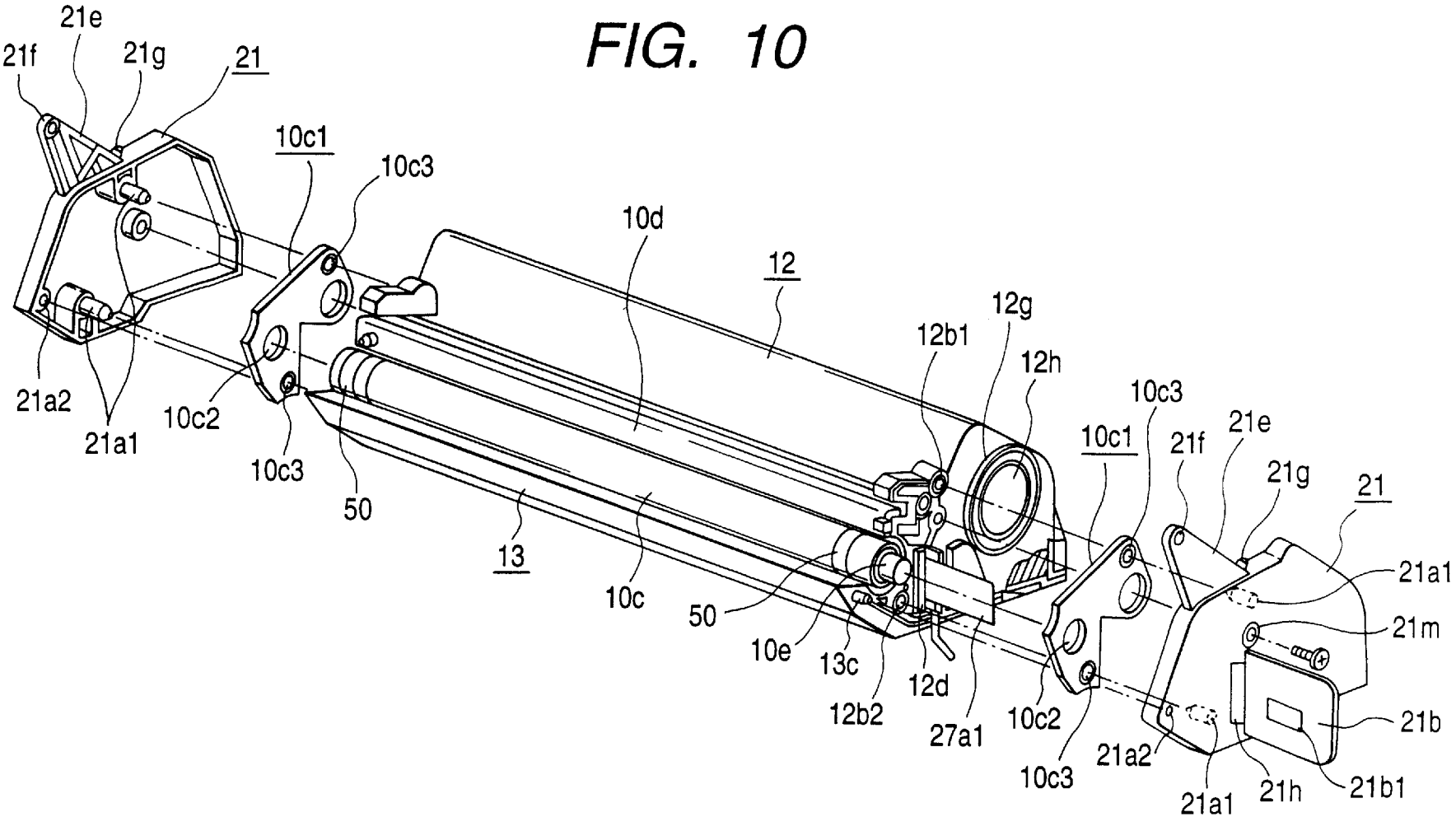
FIG. 10 is a perspective view for illustrating the assembly of an end member to the toner developing frame.

Next, the configuration of the developing means will be described with reference to FIGS. 5 to 10. FIG. 5 is a sectional view for illustrating the developing means, FIG. 6 is an explanatory view of the developing means, in which the toner developing frame and the toner developing wall member are separated from each other, FIG. 7 is a view for illustrating the assembly for connecting the toner developing frame to the toner developing wall member, FIG. 8 is a view for illustrating the connection of a toner seal member to the toner developing frame, FIG. 9 is a view for illustrating the support construction of the developing roller, and FIG. 10 is a view for illustrating the assembly for connecting an end member, which is provided at the toner seal end portion, to the toner developing frame.

Figure 6:
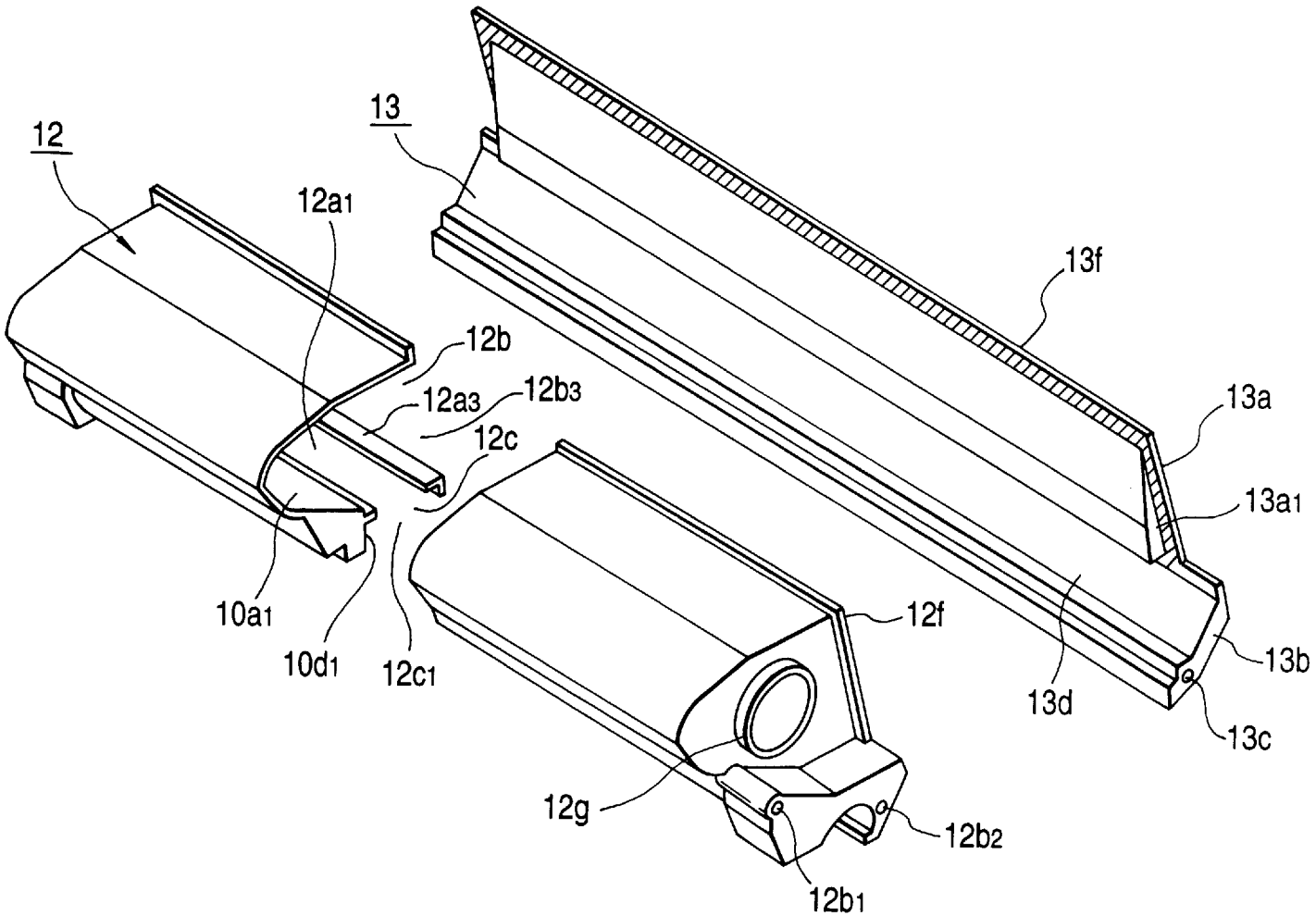
FIG. 6 is a perspective view showing a toner developing frame and a toner developing wall member which are separated from each other.

As shown in FIGS. 5 and 6, the developing means 10 forms the toner chamber 10*a* and the developing chamber 10*b* by connecting the toner developing frame 12 to the toner developing wall member 13.

Also, the toner developing frame 12 is formed with a toner passage opening 12*a*1 through which the toner contained in the toner chamber 10*a* passes when the toner is supplied to the developing roller 10*c*.

The toner developing frame 12, which is a main body forming the toner chamber 10*a* and the developing chamber 10*b*, has a toner chamber portion 12*b* for forming the toner chamber 10*a* above a seal mounting portion 12*a* having the toner passage opening 12*a*1, and has a developing chamber portion 12*c* for forming the developing chamber 10*b* below the seal mounting portion 12*a*. The toner developing frame 12 is configurated so that wall portions 12*a*3 and 12*c*1 of the same plane of the toner chamber portion 12*b* and the developing chamber portion 12*c* are open. The toner chamber portion 12*b* is formed so as to be wider on the open side, and the toner chamber 10*a* is formed with a toner filling port 12*g* for filling toner at one end portion in the longitudinal direction.

On the other hand, the toner developing wall member 13, which is connected to the open wall portion of the toner developing frame 12, is integrally made up of a toner wall portion 13*a* connecting with the open plane of the toner chamber 10*a* of the toner developing frame 12 and a developing wall portion 13*b* connecting with the open plane of the developing chamber 10*b*. At the boundary between the toner wall portion 13*a* and the developing wall portion 13*b*, a step is provided so that there is formed a concave portion 13*a*1 where the toner wall portion 13*a* is depressed with respect to the developing wall portion 13*b* as viewed from the outside.

Both of the toner developing frame 12 and the toner developing wall member 13 are formed by injection molding of resin.

In order to assemble these elements, the toner developing wall member 13 is joined to the open wall portion of the toner developing frame 12, and the joined portion is welded. In this embodiment, when the toner developing wall member 13 is connected to the toner developing frame 12, end members 21 are installed at both ends in the longitudinal direction of both the members 12 and 13 so that these are positioned accurately as shown in FIG. 7.

For this purpose, boss holes 12*b*1 and 12*b*2 for positioning are formed in the side faces at both ends in the longitudinal direction of the toner developing frame 12, and similarly a boss 13*c* for positioning is provided on the side faces at both ends in the longitudinal direction of the toner developing wall member 13. The end member 21 is provided with bosses 21*a*1 and a boss hole 21*a*2, as positioning means, which can be engaged with the boss holes 12*b*1 and 12*b*2 and the boss 13*c*.

Therefore, the toner developing frame 12 and the toner developing wall member 13 are connected to each other by joining the toner developing wall member 13 to the toner developing frame 12, by welding the portion of the toner wall portion 13*a* of the joined portion, and by pressing the developing wall portion 13*b* with a toner leakage preventive seal 22 (see FIG. 5) made of urethane foam being interposed. At this time, the joined portion where the seal 22 is interposed, which is not welded, is not joined so strongly as in the case of welding. However, the bosses 21*a*1 of the end member 21 are inserted into the boss holes 12*b*1 and 12*b*2 of the toner developing frame 12, and the boss 13*c* of the toner developing wall member 13 is inserted into the boss hole 21*a*2 of the end member 21, by which the toner developing frame 12 and the toner developing wall member 13 are positioned each other. Even if a force such as a torsion or the like is applied to the joined portion, no gap is produced at the joined portion, so that there is no possibility of leaking of toner from this portion.

The end member 21 has an arm portion 21*e* projecting toward the cleaning frame 14. By a pin (not shown) inserted into a connection hole 21*f* in the longitudinal direction formed at a distal end of the arm portion 21*e* and a connection hole (not shown) formed in the cleaning frame 14, the cleaning frame 14 and the end member 21 are rotatably connected to each other. A compression coil spring (not shown), whose inside diameter is fitted onto a spring holder 21*g* on the arm portion 21*e*, is provided under compression between the cleaning frame 14 and the spring holder 21*g*, by which gap holding members 50 on both sides of a the developing roller 10*c* are pressed on the photosensitive drum 7.

When the toner developing frame 12 and the wall member 13 are connected to each other as described above, the lower end of the toner wall portion 13*a* substantially agrees with an edge of the toner passage opening 12*a*1 because the concave portion 13*a*1 is formed in the wall member 13 (see FIG. 5). By bonding or welding a seal member 27 serving as a sealing member to the toner passage opening 12*a*1, the opening 12*a*1 is sealed so as to be capable of being unsealed.

By connecting the cleaning frame 14, to which the photosensitive drum 7, cleaning means 11, or the like are assembled, to the toner developing frame 12 and the wall member 13 integrated as described above, the process cartridge B is assembled.

At this time, as shown in FIG. 5, the shape of the toner developing frame 12 is formed so that the toner chamber 10*a* is located above the developing chamber 10*b* and a part of the toner chamber 10*a* projects from the developing chamber 10*b* toward the photosensitive drum 7.

Also, the toner developing frame 12 is provided with a developing blade mounting portion 10*d*1 for mounting the developing blade 10*d* which regulates an amount of toner adhering to a peripheral surface of the developing roller 10*c* mounted to a developing means mounting portion 13*d* that the toner developing wall member 13 has. A wall portion 10*a*1 constituting a toner containing portion that the toner developing frame 12 has is inclined toward the toner passage opening 12*a*1. Therefore, the toner in the toner containing portion can be supplied to the developing region without waste. The toner passage opening 12*a*1 is provided with the seal member 27 for sealing the toner passage opening 12*a*1 so as to be capable of being unsealed. By this seal member 27, the toner in the toner containing portion is prevented from leaking before the use of the process cartridge. The seal member 27 is removed by the operator prior to the use of the process cartridge.

The cover member (toner wall portion 13*a*) that the toner developing wall member 13 has is provided with an inclined surface 13*a*2 which is inclined toward the toner passage opening 12*a*1 when the toner developing frame 12 and the toner developing wall member 13 are connected to each other. A lower end 13*a*3 of the inclined surface 13*a*2 substantially agrees with the lower edge of the toner passage opening 12*a*1. Therefore, the toner in the toner containing portion can be supplied to the developing region without waste.

When the toner developing frame 12 and the toner developing wall member 13 are connected to each other, the end portions 12*f* and 13*f* on the side on which the toner containing portion is provided are connected to each other. This connection is effected by welding (for example, ultrasonic welding), bonding, or screwing, or by using a clip, spring, or the like. Further, in order to connect the toner developing frame 12 and the toner developing wall member 13 to each other, there are provided the end members 21 which are connected to both ends in the longitudinal direction of the toner developing frame 12 and the toner developing wall member 13. The toner developing wall member 13 is provided with the bosses 13*c* serving as positioning portions at the ends in the longitudinal direction thereof. Therefore, when the toner developing frame 12 and the toner developing wall member 13 are connected to each other, the bosses 13*c* are engaged with the boss holes 21*a*2 serving as positioning portions formed in the end members 21, by which both of the frames are positioned. Further, when the toner developing frame 12 and the toner developing wall member 13 are connected to each other, the side on which the developing means mounting portion 13*d* is provided is connected with the elastic seal member (toner leakage preventive seal 22) being interposed.

Each of the toner developing frame 12 and the toner developing wall member 13 is made of a plastic material (for example, high-impact styrene) and is integrally molded.

Thereupon, the capacity of the toner chamber 10*a* is increased without making the process cartridge B large in size, so that much toner can be stored. Even if the capacity of the toner chamber 10*a* is increased as described above, since the toner chamber 10*a* portion of the toner developing frame 12 is formed so that the open side is wide, the toner developing frame 12 can be formed by injection molding of a resin, etc.

When the seal member 27 is removed at the time of start of use, the toner in the toner chamber 10*a* is supplied to the developing chamber 10*b* located below the toner chamber 10*a* by a toner conveying member 90. Further, in the state in which the image forming apparatus A is mounted (state shown in FIG. 5), the seal mounting portion 12*a* is inclined toward the right downside. However, since the toner wall portion 13*a* is located at the lower edge of the toner passage opening 12*a*1 by the concave portion 13*a*1 provided in the toner developing wall member 13, the toner does not remain on the back side of the seal mounting portion 12*a*.

It is preferable to connect the toner developing frame 12 and the toner developing wall member 13 to each other by welding as described above because the joined portions adhere to each other securely so that toner leakage etc., are prevented. However, as any other method than welding, screwing, crimping, or bonding method may be used, for example, by interposing a sealing material such as polyurethane foam between the jointed portions.

Figure 21:
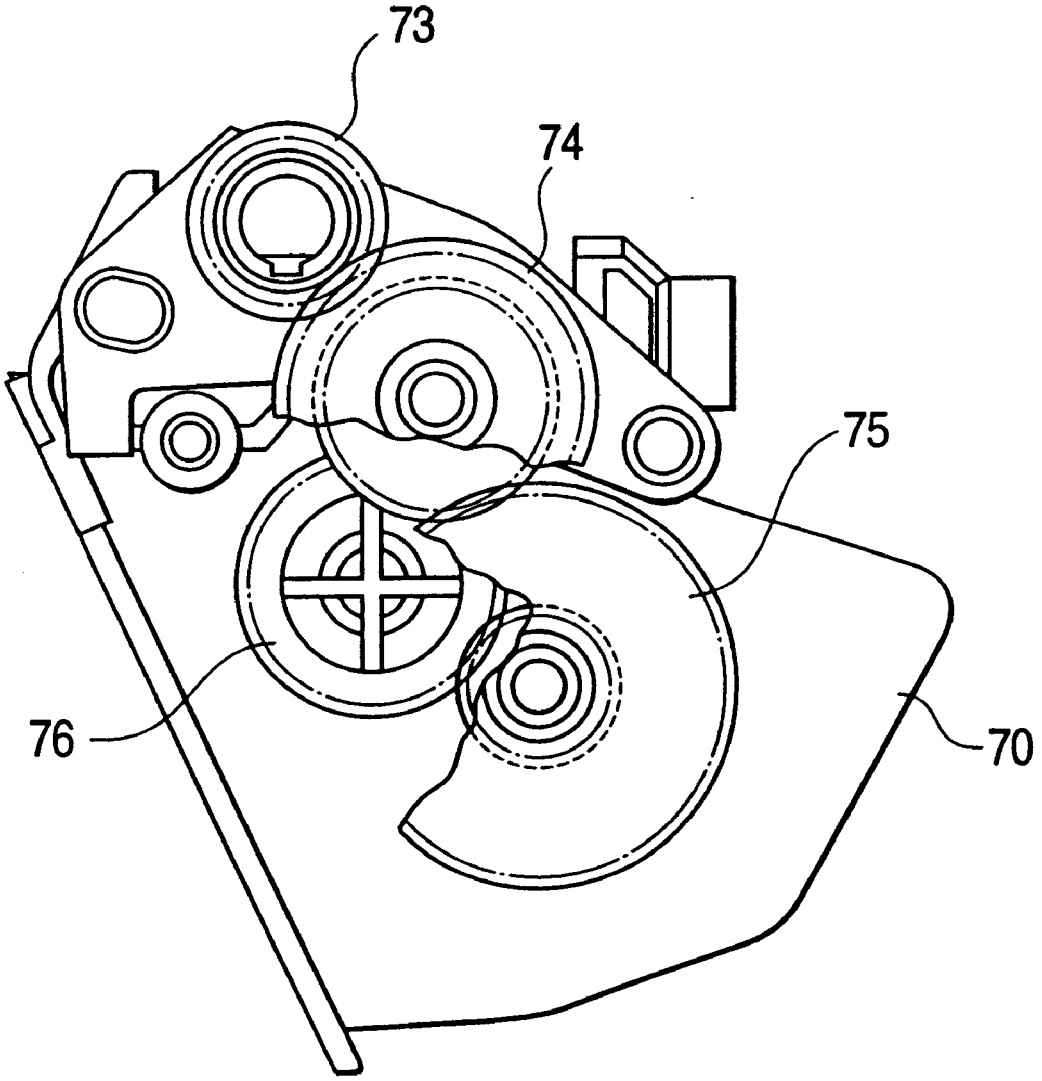
FIG. 21 is a view for illustrating the driving side of the process cartridge.

As shown in FIG. 2, in the toner chamber 10*a* of the developing means 10, the toner conveying member 90 for agitating and conveying toner is rotatably provided to convey toner from the toner chamber 10*a* to the developing chamber 10*b*. Also, as shown in FIG. 21, one end of the toner conveying member 90 is connected to a conveying gear 76. Therefore, a driving force is transmitted from a drum gear (not shown) fixed to the end of the photosensitive drum 7 to the conveying gear 76 via a developing roller gear 73, which is engaged with the drum gear and is fixed to the end of the developing roller 10*c*, and idler gears 74 and 75, so that the toner conveying member 90 is driven.

(Configuration of end member and handle member)

One of the end members 21 covers a gear train comprising the developing roller gear 73 (see FIG. 21), which is engaged with the drum gear (not shown) fixed to the end of the photosensitive drum 7 and is fixed to the end of the developing roller 10*c*, and the idler gears 74 and 75 for transmitting the driving force from the developing roller gear 73 to the conveying gear 76 of the conveying member 90. The other of the end members 21 is provided with a handle member 21*b*, which will be described below.

Figure 11:
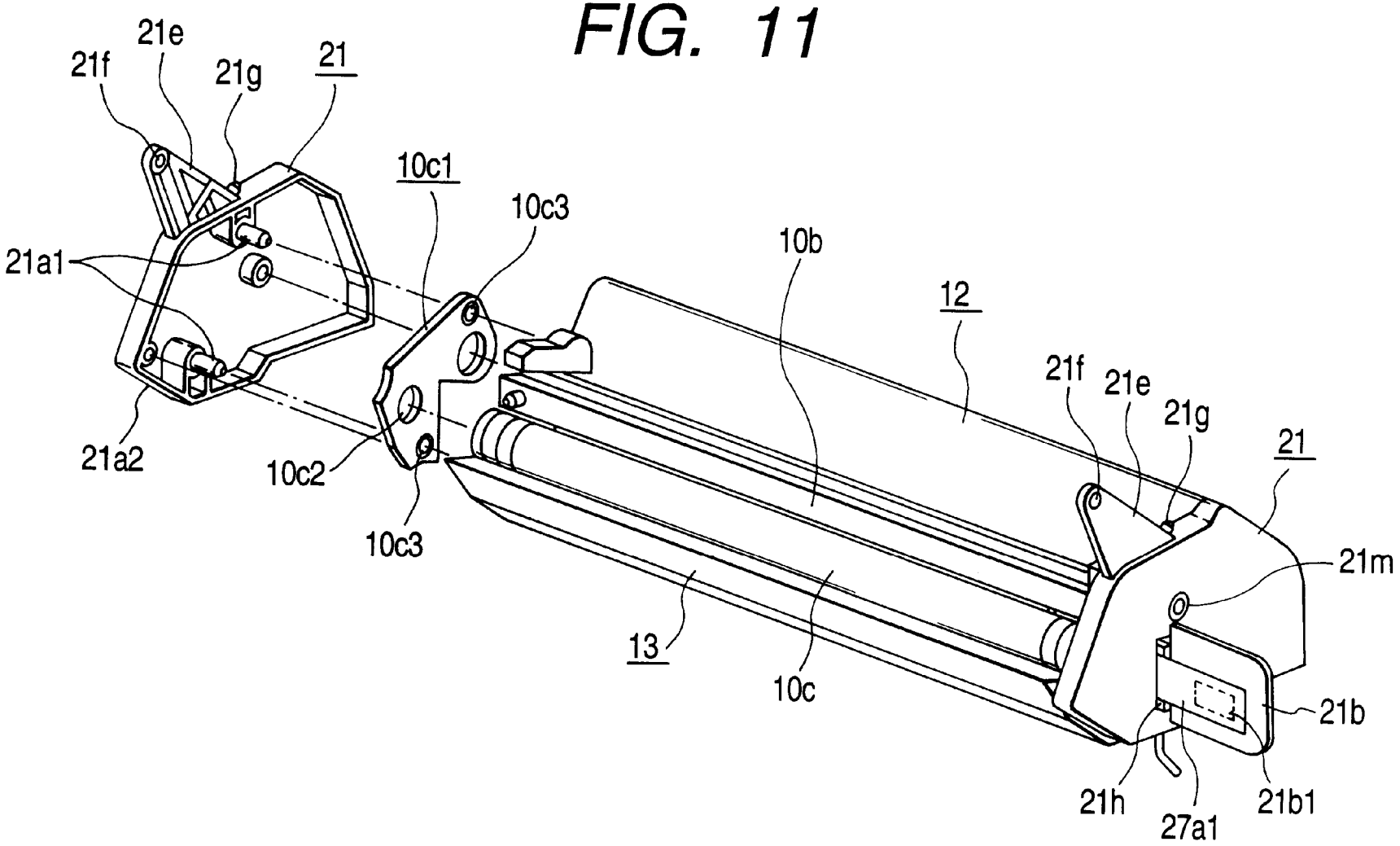
FIG. 11 is a view for illustrating the assembly of the end member.
Figure 12:
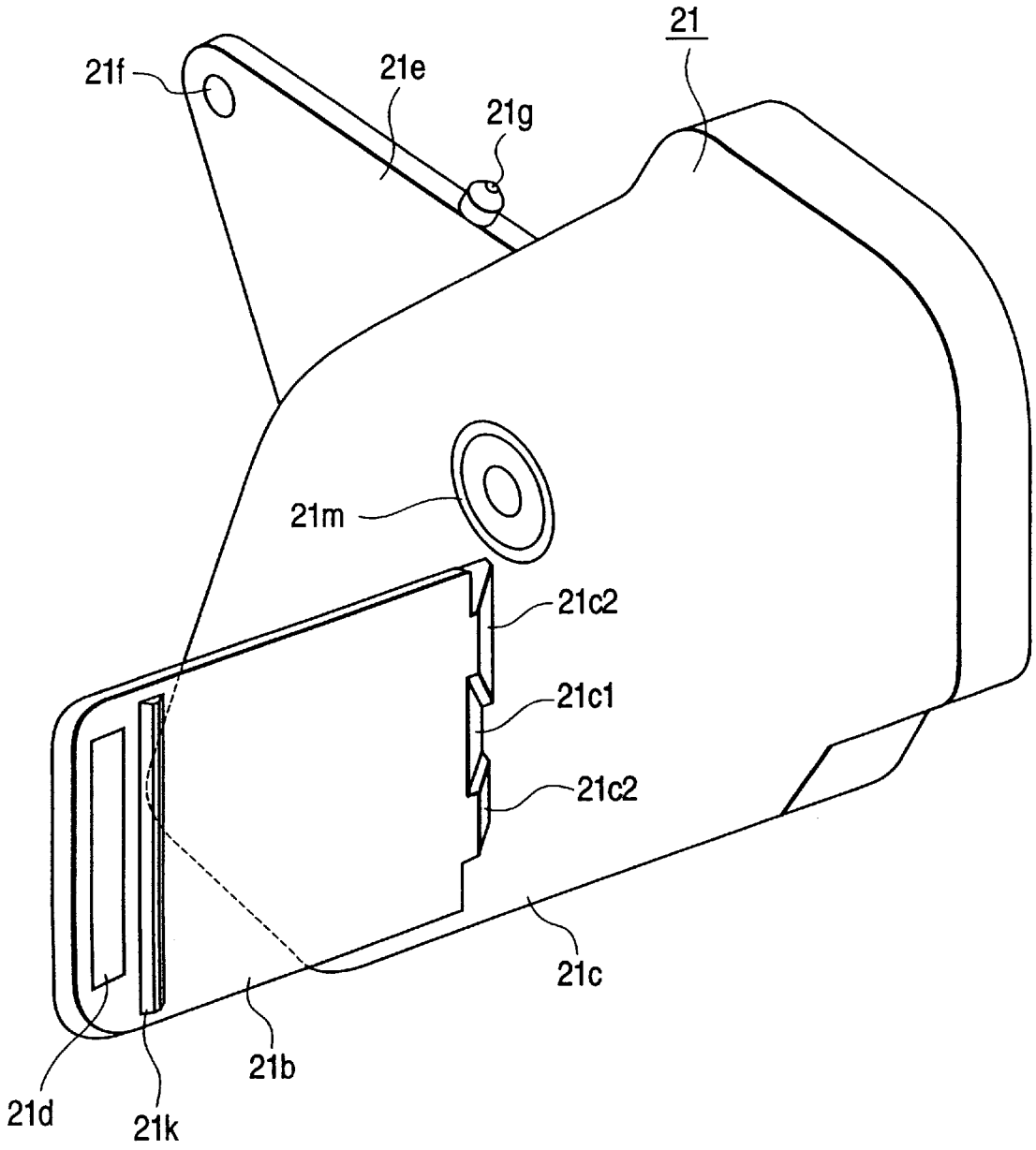
FIG. 12 is a perspective view of the end member.
Figure 13:
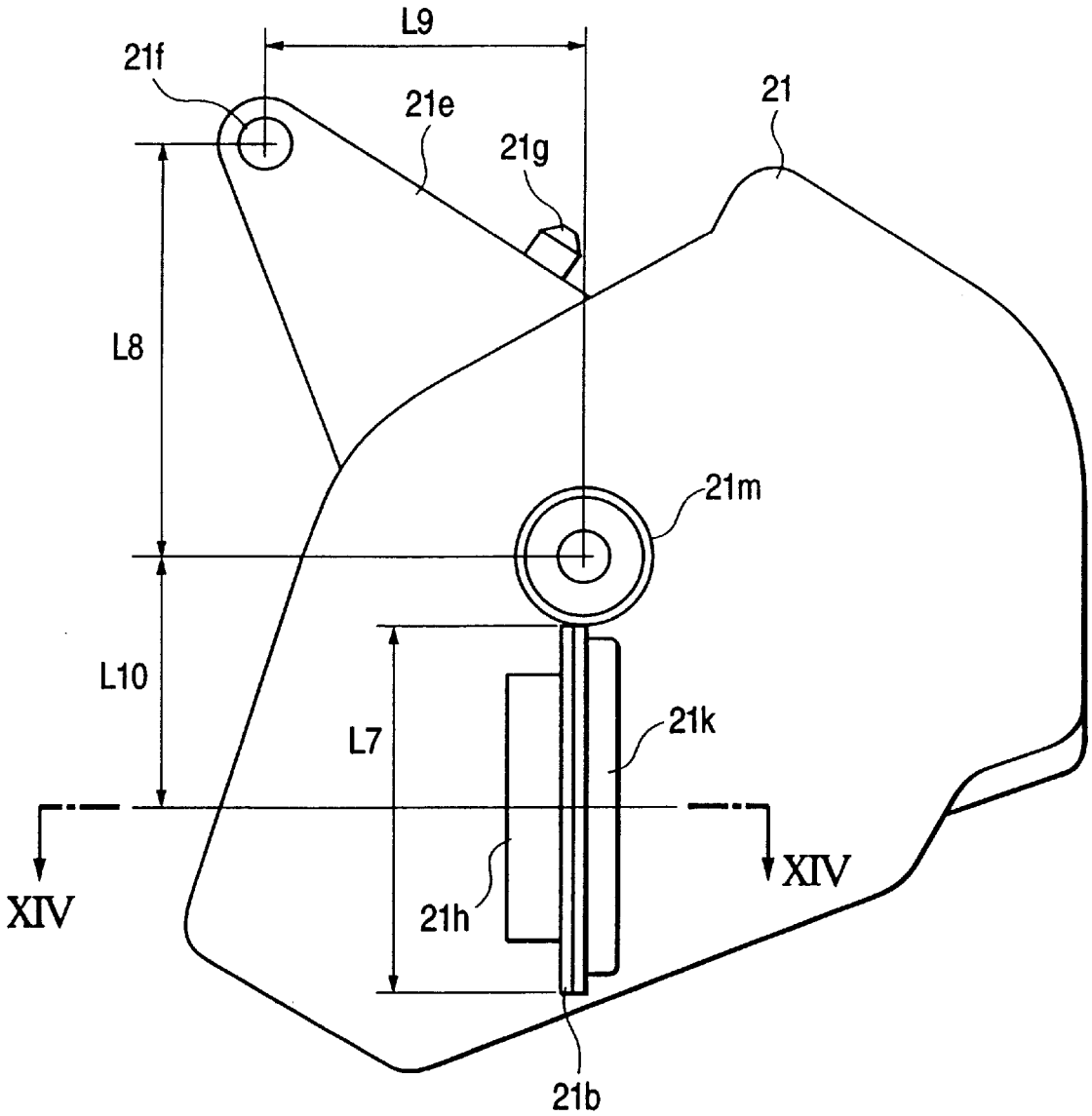
FIG. 13 is a side view of the end member.
Figure 14:
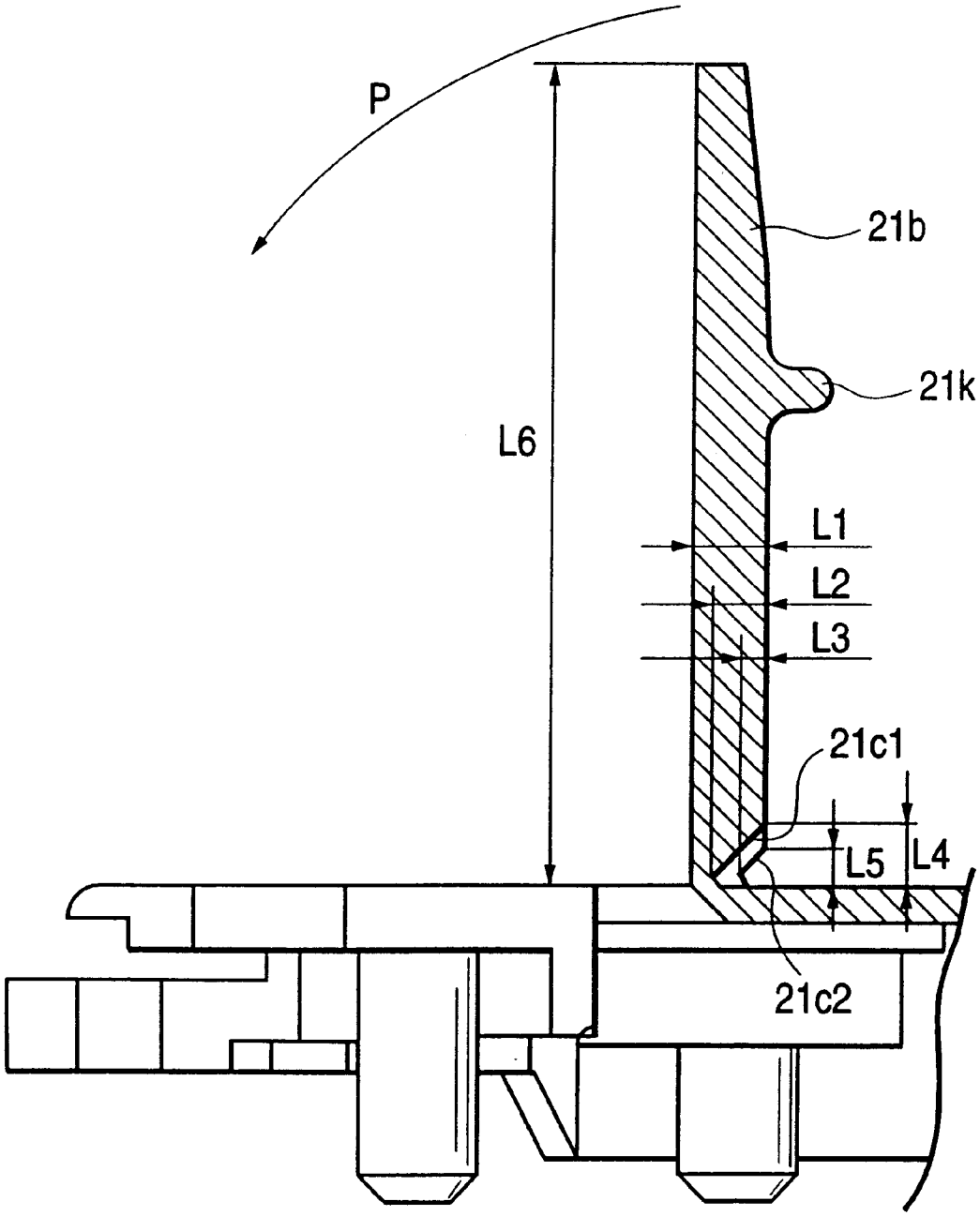
FIG. 14 is a sectional view taken along the line XIV—XIV of FIG. 13.

The following is a detailed description of the configuration of the handle member and the toner seal member. FIG. 11 is a view for illustrating the assembly of the end member, and FIGS. 12, 13 and 14 are detailed explanatory views of the handle member.

As shown in FIG. 8, a cover film 27*b*, which is easily torn in the longitudinal direction, is affixed to the seal mounting portion 12*a* so as to cover the toner passage opening 12*a*1 of the toner developing frame 12 (see FIG. 5). This cover film 27*b* is affixed to the seal mounting portion 12*a* along the edge of four sides of the toner passage opening 12*a*1. In order to unseal the toner passage opening 12*a*1, a tear tape 27*a* for tearing the cover film 27*b* is welded to the cover film 27*b*. This tear tape 27*a* is folded at a seal mounting portion end 12*a*2 at one end in the longitudinal direction of the toner passage opening 12*a*1, being caused to pass through a hole 12*d* (see FIG. 10) of the toner developing frame 12, and is pulled out to the outside. An end portion 27*a*1 of the tear tape 27*a*, which is pulled out to the outside, further is caused to pass through a hole 21*h* of the end member 21 and pulled out to the outside, and is attached to the plate-shaped handle member 21*b* serving as a handle. The handle member 21*b* is provided so as to be capable of being removed from the end member 21. Specifically, the wall thickness of a connecting portion 21*c* connecting with the end member 21 is especially decreased so as to be bent and separated. Also, the handle member 21*b* and the end member 21 are molded integrally. By such integral molding, the cost can be reduced as compared with the case where the handle member 21*b* and the end member 21 are separate parts. Preferably, the integral molding is performed by using high-impact polystyrene. The end portion of the tear tape 27*a* is bonded to the handle member 21*b* with an adhesive double coated tape 21*b*1 or the like or welded thereto.

The end portion 27*a*1 of the tear tape 27*a* projecting to the outside of the process cartridge B and the proximal side of the handle member 21*b* are separated from the end member 21, and then after the tear tape 27*a* is pulled out and the cover film 27*b* is torn by pulling the torn handle member 21*b* with the operator's finger being put against a protrusion 21*k* of the handle member 21*b*, whereby the toner passage opening 12*a*1 of the toner developing frame 12 is unsealed, so that the toner T contained in the toner developing frame 12 can be sent from the toner chamber 10*a* to the developing chamber 10*b*. As shown in FIG. 12, the handle member 21*b* has a display portion 21*d* for identifying the process cartridge. By characters, colors, etc. put on the display portion 21*d*, the user can easily check whether or not the process cartridge is a proper product. Also, as shown in FIGS. 13 and 14, if the protrusion 21*k*, which is a protrusion in the width direction, is provided on the handle member 21*b*, a force can easily be applied to the handle member 21*b* to tear the handle member 21*b* from the end member 21, and also the operation efficiency for pulling the tear tape 27*a* is high because the finger can be put against the protrusion 21*k*.

The following is a further detailed description of the configuration of the end member 21.

On the side of the end member 21 on which the end member 21 is assembled to the toner developing frame 12, the bosses 21*a*1 for positioning the developing roller 10*c* are provided. Specifically, the bosses 21*a*1 are inserted through positioning holes 10*c*3 at two places of a shaft support member 10*c*1 in a state in which a shaft 10*e* at each end of the developing roller 10*c* is fitted in a support hole 10*c*2 of the shaft support member 10*c*1. Further, the bosses 21*a*1 are inserted into the positioning holes 12*b*1 and 12*b*2 of the toner developing frame 12, by which the developing roller 10*c* is positioned.

Also, on the side of the end member 21 on which the bosses 21*a*1 are provided, the boss hole 21*a*2 for positioning the toner developing frame 12 and the toner developing wall member 13 is formed. By inserting the boss 13*c* of the toner developing wall member 13 into the boss hole 21*a*2, the toner developing frame 12 and the toner developing wall member 13 are positioned.

The end member 21 is provided with the arm portion 21*e* projecting toward the cleaning frame 14. The connection hole 21*f* is formed at the distal end of the arm portion 21*e*. By inserting the pin (not shown) into the connection hole 21*f* and the connection hole (not shown) formed in the cleaning frame 14, the cleaning frame 14 and the end member 21 are rotatably connected to each other.

The arm portion 21*e* is provided with the spring holder 21*g* projecting therefrom. The compression spring (not shown) is pressed into the spring holder 21*g*, and is pressed on the cleaning frame 14, by which the gap holding members 50 on both ends of the developing roller 10*c* are pressed on the photosensitive drum 7.

Between the aforementioned two bosses 21*a*1 is formed a screw hole 21*m* for screwing the end member 21 to the toner developing frame 12.

Next, the configuration of the connecting portion 21*c* where the handle member 21*b* is connected to the end member 21 will be described in more detail.

Figure 15:
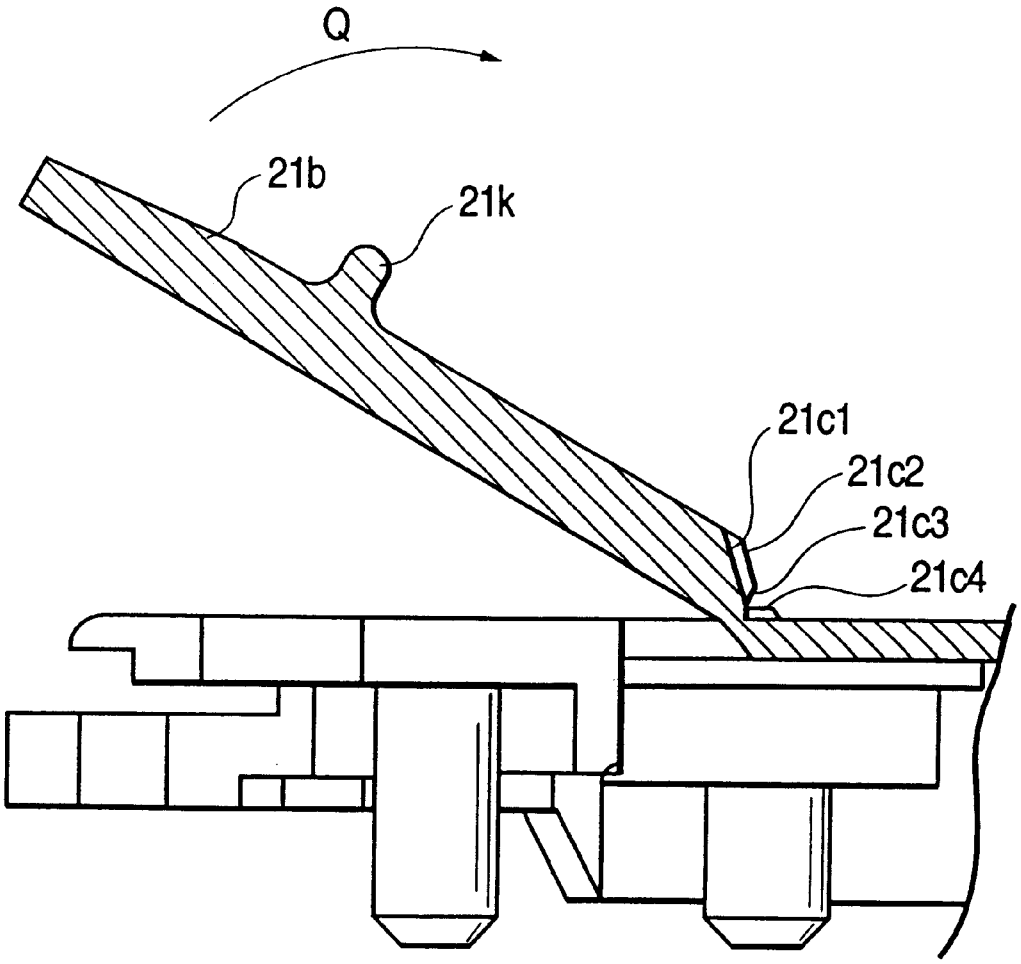
FIG. 15 is a view for illustrating a procedure for separating a handle member.
Figure 16:
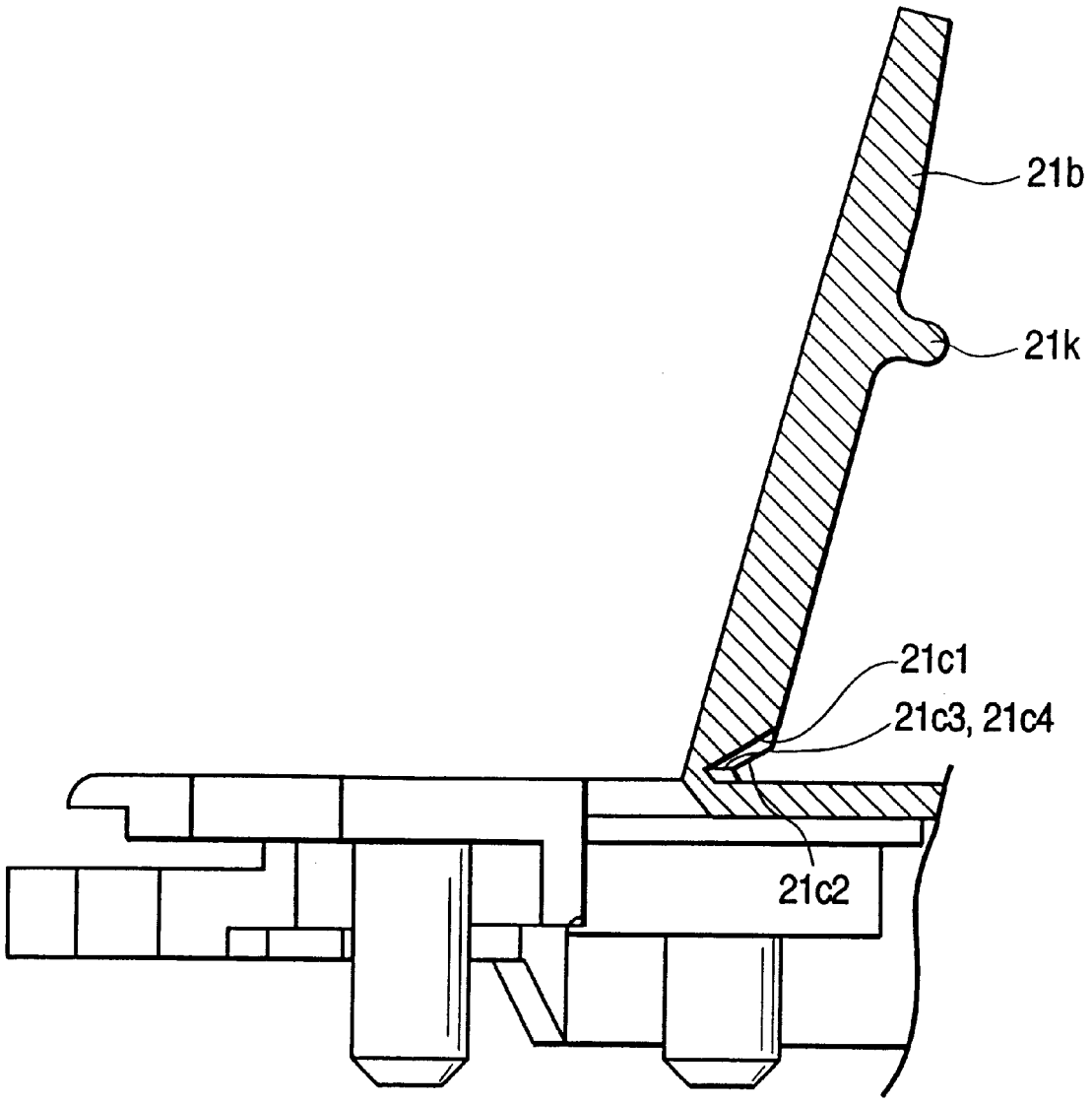
FIG. 16 is a view for illustrating a procedure for separating a handle member.

The connecting portion 21*c* has a first groove 21*c*1 formed in the center of a portion where the handle member 21*b* is separated from the end member 21 and second grooves 21*c*2 formed at one end and at the other end. The first groove 21*c*1 has a greater width and a deeper bottom than those of the second grooves 21*c*2. When the handle member 21*b* is separated from the end member 21, first, the handle member 21*b* is bent in the P direction shown in FIG. 14. Thereby, as shown in FIG. 15, a first torn face 21*c*3 and a second torn face 21*c*4 are produced at the bottom of the second groove 21*c*2. Next, the handle member 21*b* is bent in the Q direction shown in FIG. 15. Thereby, the first torn face 21*c*3 and the second torn face 21*c*4 come into contact with each other, and a tear is produced on the face on the opposite side to the face where the first groove 21*c*1 and the second grooves 21*c*2 are formed at one end portion and the other end portion of the connecting portion 21*c*. When the handle member 21*b* is bent further in the Q direction, this tear advances toward the center, and finally the handle member 21*b* is separated from the end member 21.

The following is a description of the concrete shape of the end member 21. In FIG. 14, the wall thickness L1 of the handle member 21*b* is 1 to 4 mm, preferably about 2.5 mm. The depth L2 of the first groove 21*c*1 is 1 to 3 mm, preferably about 2 mm, and the depth L3 of the second groove 21*c*2 is 0.5 to 2 mm, preferably about 1 mm. Also, the width L4 of the first groove 21*c*1 is 1.5 to 3 mm, preferably about 2.3 mm, and the width L5 of the second groove 21*c*2 is 1 to 2 mm, preferably about 1.3 mm. The length L6 of the handle member 21*b* is 25 to 30 mm, preferably about 27.3 mm, and the width L7 thereof (see FIG. 13) is 20 to 24 mm, preferably about 21.8 mm. Regarding the positional relationship between the centers of the connection hole 21*f* and the screw hole 21*m*, in FIG. 13, L8 is 26 to 29 mm, preferably about 27.6 mm, and L9 is 19 to 23 mm, preferably about 20.8 mm. Also, in FIG. 13, the distance L10 between the center of the screw hole 21*m* and the center of the handle member 21*b* is 16 to 19 mm, preferably about 17.9 mm.

(Method for assembling the developing means)

Next, an assembly process for the developing means 10 of the process cartridge will be described with reference to FIG. 10. First, the toner conveying member 90 for agitating and conveying toner is installed in the toner developing frame 12. One end of the toner conveying member 90 is rotatably supported to the toner developing frame 12, and the other end of the toner conveying member 90 is connected to the conveying gear 76 (see FIG. 21). Then, the toner seal member 27 is affixed to the seal mounting portion 12*a* of the toner developing frame 12 (see FIG. 8). The toner seal member 27 is folded back at the seal mounting portion end 12*a*2 at one end in the longitudinal direction of the toner passage opening 12*a*1, being caused to pass through the hole 12*d* of the toner developing frame 12, and is pulled out to the outside. Next, the toner developing wall member 13 is integrally welded and fixed to the toner developing frame 12 to which the toner conveying member 90 and the toner seal member 27 have been installed. Subsequently, toner is filled through the toner filling port 12*g* formed in one side face in the longitudinal direction of the toner developing frame 12.

Figure 17:
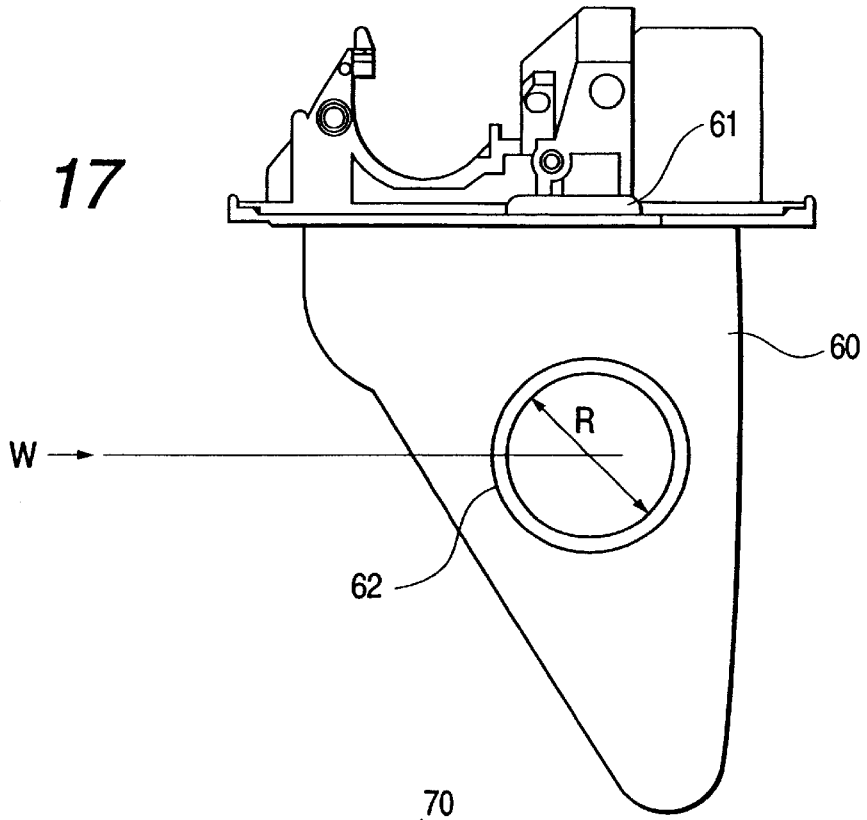
FIG. 17 is a view for illustrating a clearance between a toner filling port and a handle portion.
Figure 19:
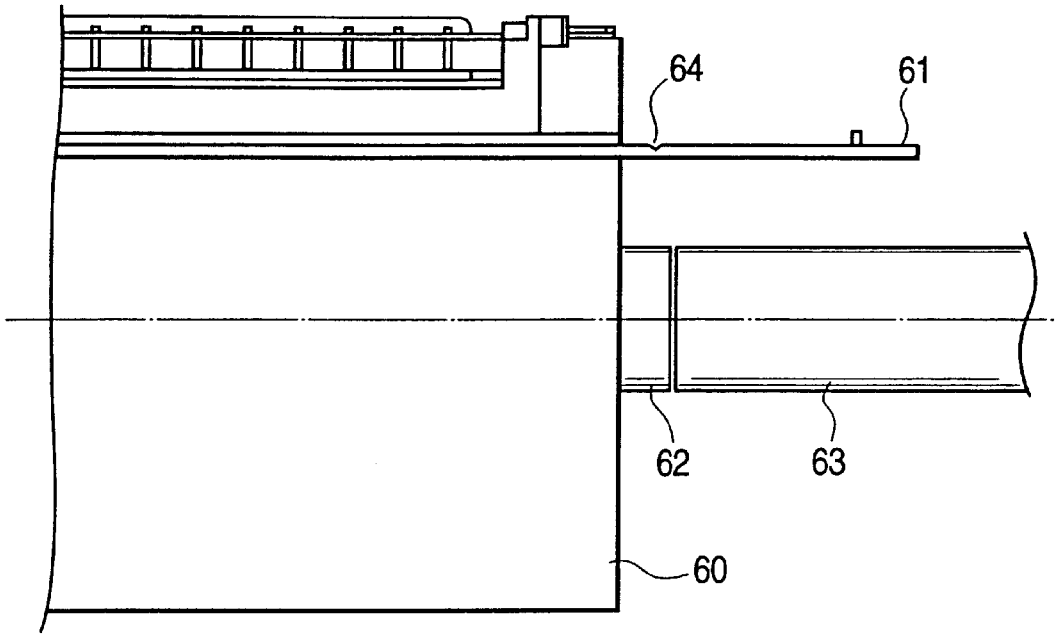
FIG. 19 is a view for illustrating a clearance between a toner filling port and a handle portion.

According to this embodiment, the toner filling work can be easily performed. The following is a detailed description of the toner filling work. FIGS. 17 and 19 show the case where a handle member 61 having a notch 64 is integrally molded on a toner vessel 60. In this case, if the handle member 61 is inadvertently bent, when toner is filled through a toner filling port 62 by using a toner filling device 63, there is a possibility of the interference between the toner filling device 63 and the handle member 61.

Also, when toner is filled through the toner filling port 62 by hand, the filling work is awkward to do because the handle member 61 is located near the toner filling port 62.

Figure 18:
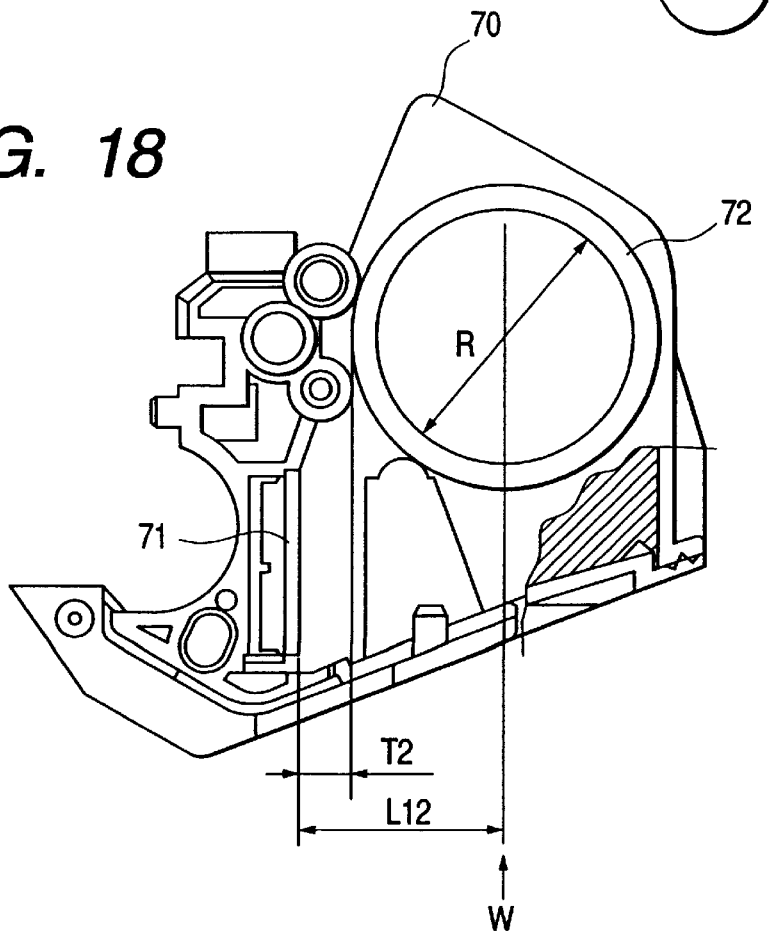
FIG. 18 is a view for illustrating a clearance between a toner filling port and a handle portion.
Figure 20:
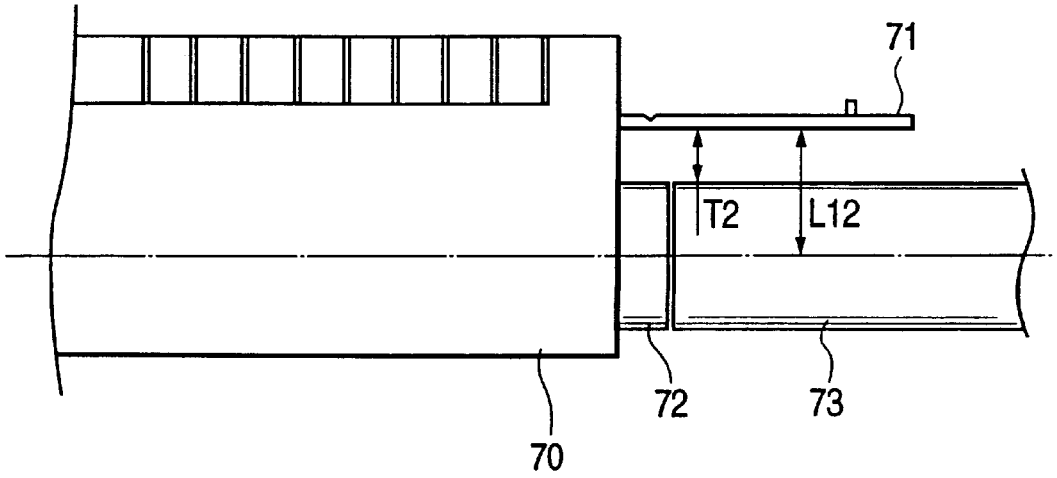
FIG. 20 is a view for illustrating a clearance between a toner filling port and a handle portion.

These problems are more serious when the toner vessel is made smaller. As shown in FIGS. 18 and 20, if the toner vessel is made smaller, the distance L12 between the centerline of a toner filling port 72 formed at one end in the longitudinal direction of a toner vessel 70 and a handle member 71 decreases. Also, the clearance T2 between a toner filling device 73 and the handle member 71 cannot be secured sufficiently. Therefore, when toner is filled, the interference between the toner filling device 73 and the handle member 71 occurs more easily.

For the small-sized toner vessel 70, it can be thought that the toner filling port 72 is moved to the opposite side (a driving side) to the handle member 71. However, on the opposite side, a gear train (idler gears 74 and 75) for transmitting a driving force from a developing roller gear 73 to the conveying gear 76 which drives a toner conveying member (not shown) for conveying toner is arranged as shown in FIG. 21. Therefore, it is difficult to arrange the toner filling port 72.

Contrary to this, according to this embodiment, the handle member 21*b* is provided on the end member, not on the toner vessel. Therefore, the work for filling toner into the toner containing portion can be easily performed regardless of the use of the toner filling device or the manual operation.

After toner is filled in this manner, the toner filling port 12*g* is sealed by a cap 12*h*. Then, the developing blade 10*d* is installed to the developing blade mounting portion 10*d*1 (see FIG. 2) of the toner developing frame 12. Next, the developing roller 10*c* is positioned to the toner developing frame 12. In positioning the developing roller 10*c*, first, the gap holding members 50 are put on both ends of the developing roller 10*c*. Then, each end of the shaft 10*e* is fitted in the support hole 10*c*2 of a shaft support member 10*c*1. Next, the developing roller gear is installed to one end of the shaft 10*e*. Subsequently, the bosses 21*a*1 of the end member 21 are inserted through positioning holes 10*c*3 at two places of the shaft support member 10*c*1, and are inserted into the positioning holes 12*b*1 and 12*b*2 of the toner developing frame 12, by which the developing roller 10*c* is installed and fixed. This end member 21 is provided at one end in the longitudinal direction of the toner chamber 10*a* so as to cover the toner filling port 12*g*. Also, the boss 13*c* of the toner developing wall member 13 is inserted into the boss hole 21*a*2 of the end member 21, by which the toner developing frame 12 and the toner developing wall member 13 are positioned. When the end member 21 is installed, the end portion 27*a*1 of the toner seal member 27, which has passed through the hole 12*d* of the toner developing frame 12 and has been pulled out to the outside, is inserted through the hole 21*h* of the end member 21 and pulled out to the outside, and then fixed to the handle member 21*b* integrally molded on the end member 21 with an adhesive double coated tape 21*b*1 (see FIG. 11).

As described above, the present invention provides an end member used for a process cartridge having an electrophotographic photosensitive member; a developing member for developing a latent image formed on the electrophotographic photosensitive member; a developer containing portion for containing developer used for the developing of the developing member; a developer filling port, which is provided at one end in the longitudinal direction of the developer containing portion, for filling the developer into the developer containing portion; a developer passage opening through which the developer contained in the developer containing portion passes when the developer is supplied to the developing member; and a sealing member for sealing the developer passage opening so as to be capable of being unsealed.

The end member has a detachable handle member, which connects with one end in the longitudinal direction of the sealing member, and which is held when the sealing member is unsealed. The end member is mountable at one end in the longitudinal direction of the developer containing portion to cover the developer filling port.

Also, the handle member is integrally provided so as to be separable from the end member.

Also, the end member and the handle member are made of a plastic material and are integrally molded.

Also, the handle member has a flat plate shape, and a protrusion in the direction crossing the longitudinal direction of the sealing member is integrally molded on the plate.

Also, the wall thickness of the handle member is 1 to 4 mm.

Also, the wall thickness of the handle member is about 2.5 mm.

Also, the handle member is provided with a first groove in the center in the longitudinal direction of a portion where the handle member is separated from the end member, and second grooves, which are shallower than the first groove, at one end portion and the other end portion.

Also, the depth of the first groove 1 to 3 mm, and the depth of the second groove is 0.5 to 2 mm.

Also, the end member further has a screw hole for screwing the end member to the developer containing portion, and the distance between the center of the screw hole and the center of the handle member, as viewed in the depth direction of the screw hole, is 16 to 19 mm.

Also, the distance between the center of the screw hole and the center of the handle member is about 17.9 mm.

According to the above-described embodiment, there can be provided an end member capable of facilitating the work for filling developer into the developer containing portion regardless of the use of a developer filling device or the manual operation, and a process cartridge in which the end member is used.

As described above, according to the present invention, the unsealing operation efficiency of the sealing member can be improved.

What is claimed is:

1. An end member used for a process cartridge, the process cartridge including: an electrophotographic photosensitive member; a developing member for developing a latent image formed on the electrophotographic photosensitive member; a toner frame having a developer containing portion for containing developer to be used for developing the latent image by the developing member, a developer filling port, which is provided at one end in a longitudinal direction of the developer containing portion, for filling the developer into the developer containing portion, and a developer passage opening through which the developer contained in the developer containing portion passes when the developer is supplied to the developing member; a toner cap attached to the toner frame for plugging the developer filling port; and a sealing member for sealing the developer passage opening unsealably, said end member comprising:

a separable handle member, which is connectable with one end in a longitudinal direction of the sealing member, and which is gripped when the sealing member is pulled out for unsealing the developer passage opening, and wherein said end member is detachably mountable at one end in the longitudinal direction of the toner frame to cover the toner cap plugging the developer filling port, and wherein said end member and said handle member are made of a plastic material and are molded integrally with each other, and wherein said handle member is separable from said end member.

2. An end member according to claim 1, wherein said handle member has a flat plate shape, and wherein a protrusion in a direction crossing the longitudinal direction of the sealing member is integrally molded on the flat plate shape.

3. An end member according to claim 1, wherein the thickness of said handle member is 1 to 4 mm.

4. An end member according to claim 1, wherein the thickness of said handle member is about 2.5 mm.

5. An end member according to claim 1, wherein said end member further has a screw hole for facilitating screwing said end member to the developer containing portion, and wherein the distance between the center of said screw hole and the center of said handle member, as viewed in the depth direction of said screw hole, is 16 to 19 mm.

6. An end member according to claim 5, wherein the distance between the center of said screw hole and the center of said handle member is about 17.9 mm.

7. An end member used for a process cartridge, the process cartridge including: an electrophotographic photosensitive member; a developing member for developing a latent image formed on the electrophotographic photosensitive member; a developer containing portion for containing developer used for developing the latent image by the developing member; a developer filling port, which is provided at one end in a longitudinal direction of the developer containing portion, for filling the developer into the developer containing portion; a developer passage opening through which the developer contained in the developer containing portion passes when the developer is supplied to the developing member; and a sealing member for sealing the developer passage opening unsealably, wherein said end member comprises:

a separable handle member, which is connectable with one end in a longitudinal direction of the sealing member, and which is gripped when the sealing member is unsealed, and wherein said end member is detachably mountable at one end in the longitudinal direction of the developer containing portion to cover the developer filling port, and wherein said handle member is formed integrally with said end member, and separable from said end member, and wherein said handle member is provided with a first groove in a center in a longitudinal direction of a portion where said handle member is separated from said end member, and a second groove, which is shallower than said first groove, at an end of said portion.

8. An end member according to claim 7, wherein the depth of said first groove is 1 to 3 mm, and the depth of said second groove is 0.5 to 2 mm.

9. An end member according to claim 7, wherein depth of said first groove is about 2 mm, and the depth of said second groove is about 1 mm.

10. An end member according to any one of claims 1, 2, 3, 4, 8, 9, 5, 6, or 7, further comprising an opening through which the sealing member passes, wherein the sealing member is passed through said opening to be pulled out.

11. An end member according to any one of claims 1, 2, 3, 4, 8, 9, 5, 6, or 7, further comprising an engaging portion protruding from a periphery of said end member, wherein said engaging portion is rotatably engageable with a drum frame which supports the electrophotographic photosensitive member.

12. A process cartridge attachable to and detachable from a main body of an electrophotographic image forming apparatus, comprising:

an electrophotographic photosensitive member;

a developing member for developing a latent image formed on said electrophotographic photosensitive member;

a toner frame having a developer containing portion for containing developer to be used for developing the latent image by said developing member, a developer filling port, which is provided at one end in a longitudinal direction of said developer containing portion, for filing the developer into said developer containing portion, and a developer passage opening through which the developer contained in said developer containing portion passes when the developer is supplied to said developing member;

a toner cap attached to said toner frame for plugging said developer filling port;

a sealing member for sealing said developer passage opening unsealably; and an end member which has a separable handle member, which connects with one end in a longitudinal direction of said sealing member, and which is gripped when said sealing member is pulled out for unsealing said developer passage opening, said end member being detachably mounted at one end in the longitudinal direction of said toner frame to cover the toner cap plugging said developer filling port, and wherein said end member and said handle member are made of a plastic material and are molded integrally with each other, and wherein said handle member is separable from said end member.

13. A process cartridge according to claim 12, wherein said handle member has a flat plate shape, and wherein a protrusion in a direction crossing the longitudinal direction of said sealing member is integrally molded on the flat plate shape.

14. A process cartridge according to claim 12, wherein the thickness of said handle member is 1 to 4 mm.

15. A process cartridge according to claim 12, wherein the thickness of a said handle member is about 2.5 mm.

16. A process cartridge according to claim 12, wherein said end member further has a facilitating screw hole for screwing said end member to said developer containing portion, and wherein the distance between the center of said screw hole and the center of said handle member, as viewed in the depth direction of said screw hole, is 16 to 19 mm.

17. A process cartridge according to claim 16, wherein the distance between the center of said screw hole and the center of said handle member is about 17.9 mm.

18. A process cartridge attachable to and detachable from a main body of an electrophotographic image forming apparatus, comprising:

an electrophotographic photosensitive member;

a developing member for developing a latent image formed on said electrophotographic photosensitive member;

a developer containing portion for containing developer used for developing the latent image by said developing member;

a developer filling port, which is provided at one end in a longitudinal direction of said developer containing portion, for filling the developer into said developer containing portion;

a developer passage opening through which the developer contained in said developer containing portion passes when the developer is supplied to said developing member;

a sealing member for sealing said developer passage opening unsealably; and an end member which has a separable handle member, which connects with one end in a longitudinal direction of said sealing member, and which is gripped when said sealing member is unsealed, said end member being detachably mounted at one end in the longitudinal direction of said developer containing portion to cover said developer filling port, and said handle member being formed integrally with said end member, and being separable from said end member, wherein said handle member is provided with a first groove in a center in a longitudinal direction of a portion where said handle member is separated from said end member, and a second groove, which is shallower than said first groove, at an end of said portion.

19. A process cartridge according to claim 18, wherein the depth of said first groove is 1 to 3 mm, and the depth of said second groove is 0.5 to 2 mm.

20. A process cartridge according to claim 18, wherein the depth of said first groove is about 2 mm, and the depth of said second groove is about 1 mm.

21. A process cartridge according to any one of claims 12, 13, 14, 15, 19, 20, 16, 17, or 18, further comprising at least one of a charging member for charging said electrophotographic photosensitive member and a cleaning member for removing developer remaining on said electrophotographic photosensitive member.

22. A process cartridge according to any one of claims 12, 13, 14, 15, 19, 20, 16, 17, or 18, wherein said end member further comprises an opening through which said sealing member passes, and wherein said sealing member is passed through said opening to be pulled out.

23. A process cartridge according to any one of claims 12, 13, 14, 15, 19, 20, 16, 17, or 18, wherein said end member further comprises an engaging portion protruding from a periphery of said end member, and wherein said engaging portion is rotatably engaged with a drum frame which supports said electrophotographic photosensitive member.

* * * * *

UNITED STATES PATENT AND TRADEMARK OFFICE

CERTIFICATE OF CORRECTION

PATENT NO. : 6,137,971
DATED : October 24, 2000
INVENTOR(S) : Teruhiko Sasaki et al.

It is certified that error appears in the above-identified patent and that said Letters Patent is hereby corrected as shown below:

Title page,
Item [56], References Cited, FOREIGN PATENT DOCUMENTS,
"08/305251" should read -- 08-305251 --.

Column 1,
Line 11, "includes" should read -- include --.
Line 27, "which" should be deleted.

Column 2,
Line 25, "is provide" should read -- is to provide --.

Column 5,
Line 39, "not illustrated" should read -- unillustrated --.

Column 7,
Line 2, "positioned each other" should read -- positioned with respect to each other --.
Line 17, "of a the" should read -- of the --.

Column 8,
Line 48, "as any" should read -- any --.

Column 9,
Line 45, "after" should be deleted.

Column 12,
Line 66, "groove 1" should read -- groove is 1 --.

UNITED STATES PATENT AND TRADEMARK OFFICE

CERTIFICATE OF CORRECTION

PATENT NO. : 6,137,971
DATED : Qctober 24, 2000
INVENTOR(S) : Teruhiko Sasaki et al.

It is certified that error appears in the above-identified patent and that said Letters Patent is hereby corrected as shown below:

Column 14,
Line 33, "depth" should read -- the depth --.

Signed and Sealed this

Fifth Day of February, 2002

*Attest:*

*Attesting Officer*

JAMES E. ROGAN
*Director of the United States Patent and Trademark Office*